US006230632B1

(12) United States Patent
Moore

(10) Patent No.: US 6,230,632 B1
(45) Date of Patent: May 15, 2001

(54) SELECTIVELY VARIABLE MODULAR SPACE SYSTEM WITH SHELVING AND ENCLOSURES

(76) Inventor: John C. Moore, P.O. Box 4787, Vail, CO (US) 81658

( * ) Notice: Subject to any disclaimer, the term of this patent is extended or adjusted under 35 U.S.C. 154(b) by 0 days.

(21) Appl. No.: 09/329,006

(22) Filed: Jun. 9, 1999

Related U.S. Application Data

(63) Continuation-in-part of application No. 09/122,308, filed on Jul. 24, 1998, now Pat. No. 6,123,034, which is a continuation-in-part of application No. 08/655,419, filed on May 30, 1996, now Pat. No. 5,791,265.

(51) Int. Cl.[7] ..... A47B 45/00

(52) U.S. Cl. ..... 108/180; 312/108; 312/265.4; 211/194

(58) Field of Search ..... 312/257.1, 263, 312/265.1, 265.2, 265.3, 265.4, 107, 108, 111; 108/180, 181, 91, 187; 403/397, 396, 391, 388; 211/188, 194, 181.1, 182, 186, 189

(56) References Cited

U.S. PATENT DOCUMENTS

| | | | | |
|---|---|---|---|---|
| 403,168 | | 5/1889 | Wood . | |
| 3,261,585 | | 7/1966 | Constantini et al. . | |
| 3,419,319 | | 12/1968 | Jentzen . | |
| 3,730,601 | | 5/1973 | Misenheimer, III . | |
| 3,835,354 | * | 9/1974 | Torres-Pena | 312/263 X |
| 3,848,942 | * | 11/1974 | Fanini | 312/263 X |
| 3,896,743 | * | 7/1975 | Pariente | 312/263 X |
| 4,117,783 | | 10/1978 | Eckel et al. . | |
| 4,118,081 | | 10/1978 | Barrientos . | |
| 4,147,395 | | 4/1979 | Gale . | |
| 4,191,436 | | 3/1980 | Cherry . | |
| 4,419,938 | * | 12/1983 | Kaut | 211/182 X |
| 4,434,899 | | 3/1984 | Rivkin . | |
| 4,706,824 | | 11/1987 | Mercer et al. . | |
| 4,774,792 | | 10/1988 | Ballance . | |
| 4,846,078 | | 7/1989 | Janson . | |
| 5,016,765 | | 5/1991 | Leonardo . | |

FOREIGN PATENT DOCUMENTS

| | | | | |
|---|---|---|---|---|
| 637235 | | 12/1963 | (BE) . | |
| 1121585 | | 1/1962 | (DE) . | |
| 88 08 708 | | 9/1988 | (DE) . | |
| 1150069 | * | 1/1958 | (FR) | 312/265.2 |
| 1 464 043 | | 3/1967 | (FR) . | |
| 2403893 | | 5/1979 | (FR) . | |
| 2416671 | * | 10/1979 | (FR) | 312/111 |
| 810752 | | 3/1959 | (GB) . | |
| 2137871 | | 10/1984 | (GB) . | |

* cited by examiner

*Primary Examiner*—Janet M. Wilkens
(74) *Attorney, Agent, or Firm*—Seed Intellectual Property Law Group PLLC

(57) ABSTRACT

In an improved modular space system, a first lower frame resting on a support surface such as the floor is coupled to a second frame spaced from and aligned in parallel relationship to the first frame by a plurality of posts. Each post has a bore provided in each of a top and bottom surface to receive a stud extending toward the post from one of the frames. Each of the frames has a substantially tubular cross section, and each of the top and bottom surfaces of the post is provided with a groove, having a curvature to matingly engage the tubular outer surface of the frames. Planar members are received by and extend between slots provided in the posts to provide three sides of a substantially rectangular enclosure. Supports provided on the inner surfaces of the planer members have a series of equally spaced holes, allowing an end user to position sets of rails at selected locations within the enclosure. The rails receive shelves, or slidingly receive drawers, or a combination thereof. If desired, a door is pivotally coupled between opposing surfaces of two of the forward posts. Additional frames are coupled to the enclosure in longitudinally spaced relation to each other via spacers, to form open-sided columns. Two or more columns may be coupled together via boards that extend between and rest along parallel upper surfaces of the frames, to provide a horizontal work surface.

16 Claims, 22 Drawing Sheets

SELECTIVELY VARIABLE MODULAR SPACE SYSTEM WITH SHELVING AND ENCLOSURES

CROSS REFERENCE TO RELATED APPLICATIONS

This application is a continuation-in-part of U.S. patent application Ser. No. 09/122,308, filed Jul. 24, 1998, which is now U.S. Pat. No. 6,123,034 and which is a continuation-in-part of U.S. patent application Ser. No. 08/655,419, filed May 30, 1996, now issued as U.S. Pat. No. 5,791,265.

FIELD OF THE INVENTION

The present invention relates generally to a space system such as for accommodating document files, books, business equipment, computer equipment including peripherals, photographs, and any number of other general miscellaneous items typically found in an office, or room in a home.

BACKGROUND OF THE INVENTION

As used herein, the term "space system" or "space unit" relates to a system or unit to be located in a room or any space, either in a domestic or office setting, which supports objects of great variety in an organized manner. Probably the most frequently encountered space unit is a table onto which objects are displayed or placed for easy use and retrieval. Other traditional space systems include desks, filing cabinets, and bookcases, etc. Such traditional space systems typically are of fixed geometry and size, limiting their flexibility to accommodate varying and changing needs. Such traditional space systems or furniture are also traditionally heavy and expensive.

In recent years, in an attempt to address the shortcomings of traditional solid furniture, various modular space units have been developed. However, the majority of the currently available modular systems are complicated and time consuming for the end user to assemble. In particular, such systems often require the user to follow a lengthy set of instructions and to identify a large number of parts, and use a variety of tools to assemble the space unit. Thus, while conventional modular units provide an aesthetic appearance similar to solid space units, they are time consuming and cumbersome to assemble.

A need therefore exists for an improved modular space system that is flexible to accommodate varying and changing needs of a user, while being aesthetically pleasing, easy to assemble, and relatively inexpensive to manufacture. The present invention fulfills these needs, and provides further related advantages.

SUMMARY OF THE INVENTION

Briefly, the present invention provides an improved modular space system. In accordance with a preferred embodiment of the invention, a first lower frame having a plurality of first studs extending above an upper surface of the first lower frame is positioned on a support surface, for example, the floor. A plurality of posts extend longitudinally between the first lower frame and a second frame spaced from and aligned in parallel relationship to the first frame. The second frame has a plurality of second studs, each second stud having a first portion extending above an upper surface of the second frame and a second portion extending below a lower surface of the second frame. A bore is provided in a top and bottom surface of each of the posts. The bores are provided in the bottom surfaces of the posts to receive the first studs of the first lower frame while the bores in the top surfaces of the posts receive the second portions of the studs extending downward from the second frame. Planar members extend between the plurality of posts to define three sides of an enclosure having a substantially rectangular configuration. In a preferred embodiment, gliders are coupled to an inner surface of opposing sides of the enclosure to slidingly receive a set of drawers. In an alternative embodiment, a door is pivotally coupled between opposing surfaces of two of the posts to selectively allow access to the enclosure.

A plurality of longitudinal spacers having openings on opposite ends are received on the first portion of the second studs extending upward from the second frame. A third frame spaced from and aligned with the second frame has a plurality of third studs that extend below a lower surface of the third frame into the open top ends of the longitudinal spacers. The plurality of third studs also extend upward from an upper surface of the third frame to engage a second set of longitudinal spacers. In this manner, a selected number of frames and longitudinal spacers are coupled together to form a column of a selected height. Two or more columns assembled in this fashion may be laterally spaced from each other and coupled together by a planar member extending between the columns and resting on an upper surface of selected frames, thereby forming a work surface.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE INVENTION

Figure 1:
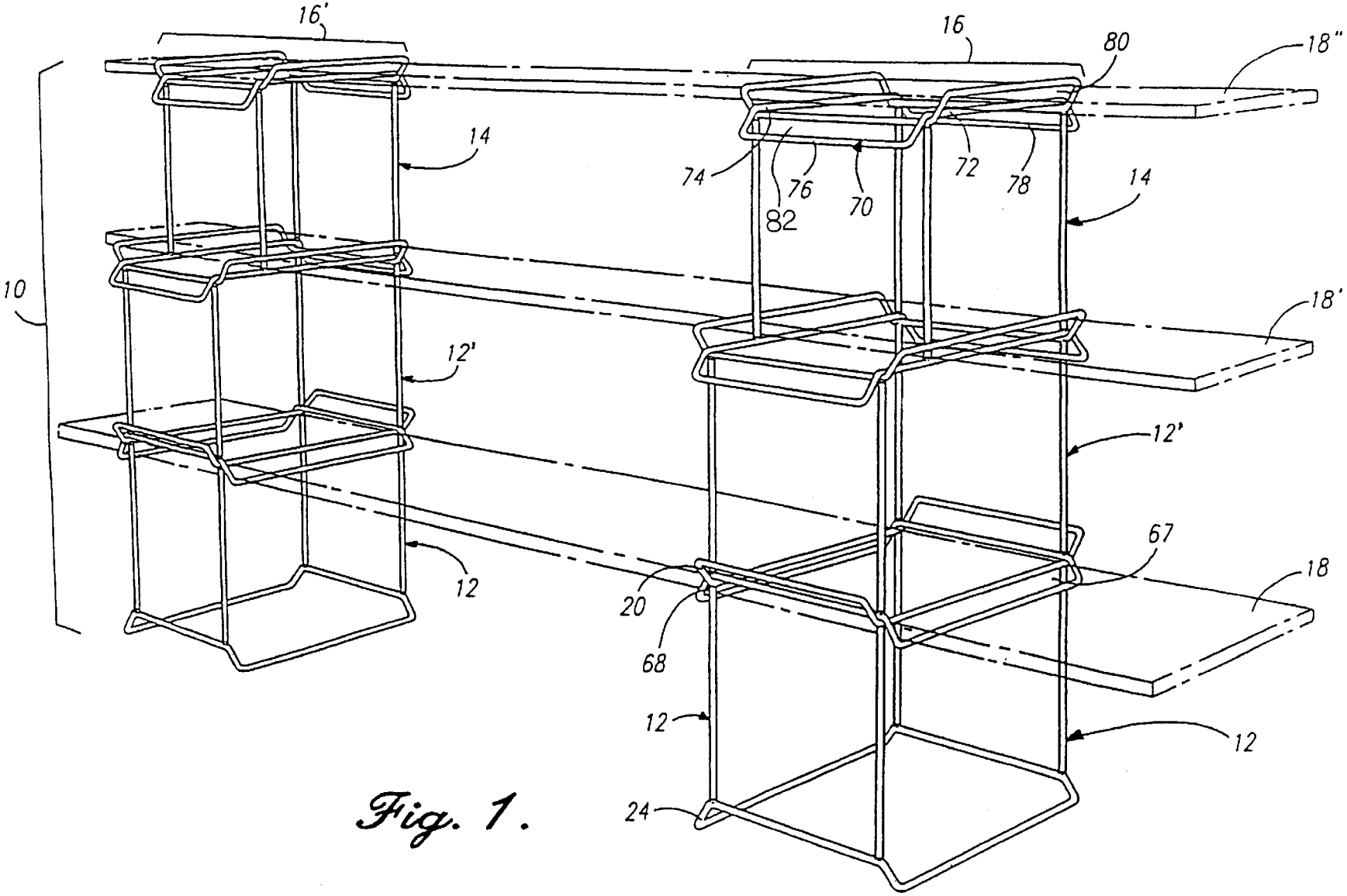
FIG. 1 is a perspective view of one version of space system of the present invention.

In the ensuing detalled description of a preferred embodiment of the invention, reference is made to the drawing and initially particularly to FIG. 1. As shown there, the system 10 to be described includes a plurality of first and second open-sided modular frames 12 and 14, respectively, assembled together to provide a number of separate columns 16, 16' for example, the lowermost modular frame resting on a suitable ground plane (e.g., floor) which is not shown. Moreover, in a way that will be more particularly described, one or more shelving elements 18, 18', 18", removably interrelate two or more columns, which shelving elements can support and display a miscellany of equipment, files, books or other objects on an upwardly directed surface.

Figure 2:
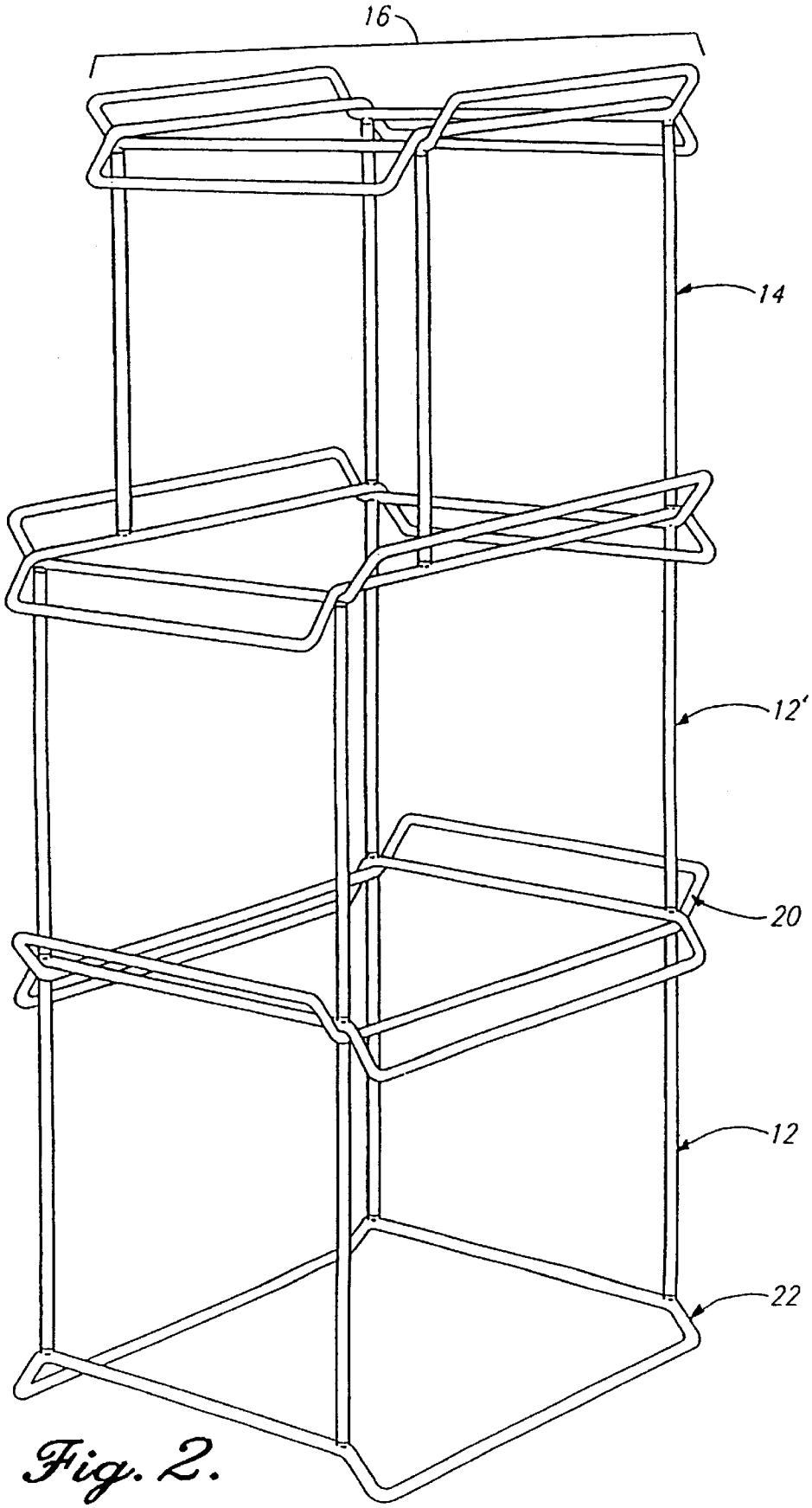
FIG. 2 is a perspective view of one form of column of the present invention.
Figure 3:
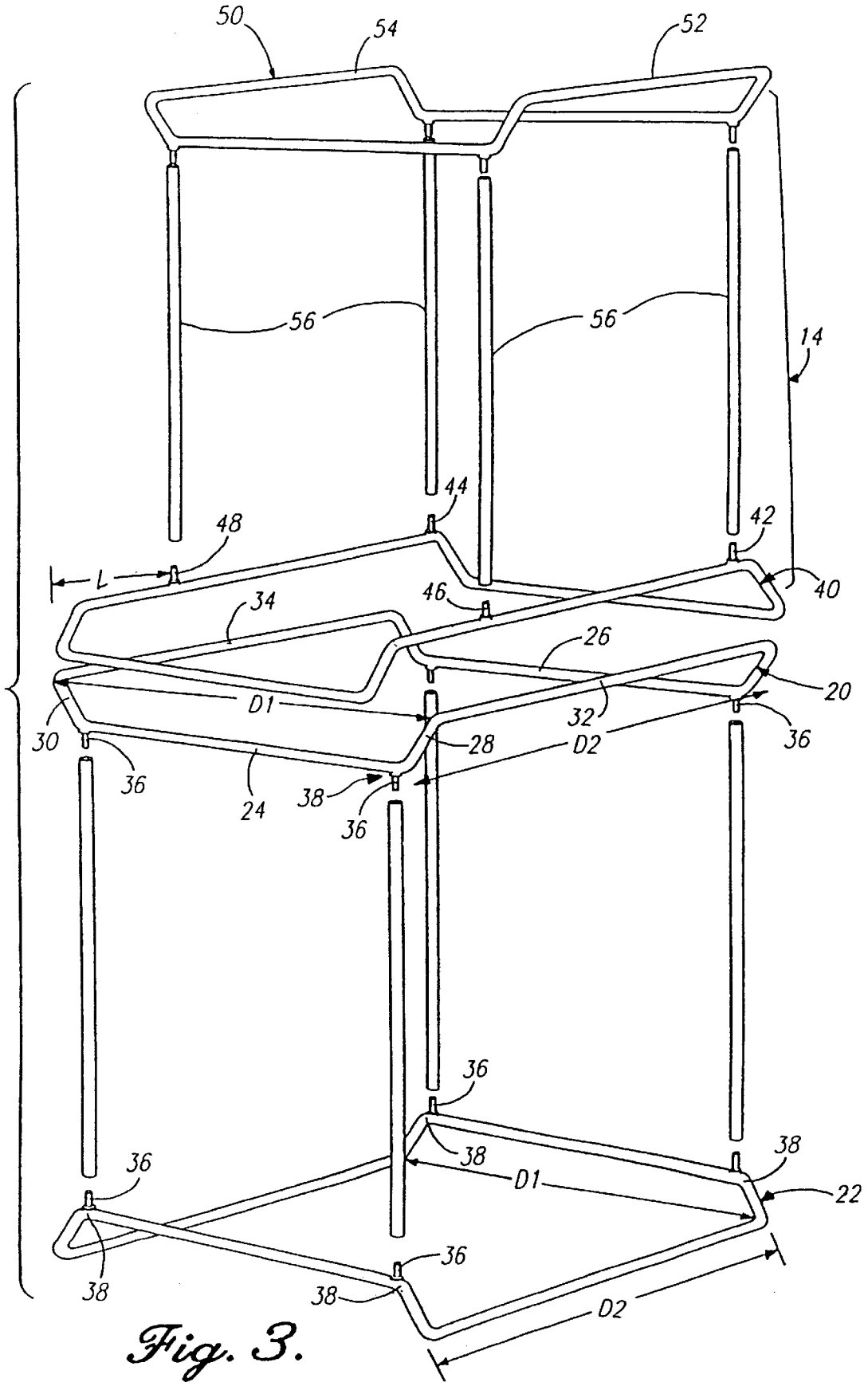
FIG. 3 depicts in exploded view two forms of modular frames of this invention.

With simultaneous reference to FIGS. 2 and 3, the first modular frame 12 is seen to include an upper base 20 and lower base 22, both of rectangular geometry and constructed from metal tubes or rods which form the outer sides of the bases. More particularly, the upper base 20 is constructed of a single tube or rod formed into first and second spaced-apart equilength parallel sides 24 and 26 which have end portions 28 and 30 that are bent upwardly at an angle to join third and fourth parallel base sides 32 and 34, respectively.

Accordingly, the base 20 has its sides 24, 26 forming a plane that is parallel to and spaced from the plane formed by the third and fourth sides 32, 34. Also, the third and fourth sides are spaced from one another a distance D1 that is greater than the spacing D2 between the first and second sides. When formed from a single rod or tube, the two opposite rod ends are preferably welded together (not shown) to form a rigid and strong closed-loop construction.

The lower base 22 is constructed the same as base 20 except that the bent end portions occur on the other opposed sides than in those of base 20. For example, if the end portions of the longer sides are bent on base 20, then the bent end portions will preferably occur on the shorter sides of base 22 (FIGS. 1 and 2).

A stub shaft 36 is welded at each of the approximate four corner points 38 of the bases 20 and 22 where the bending is accomplished to provide the end portions 28 and 30, only extending in a direction opposite to that of the bent portions (FIG. 3).

In assembly of a modular frame 12, four identical support tubes 39 (or optionally rods having a shallow axial opening in each end) have their ends received onto the stub shafts 36 of facing upper and lower bases 20 and 22 to form the overall parallelepiped form of the modular first frame 12.

Figure 5:
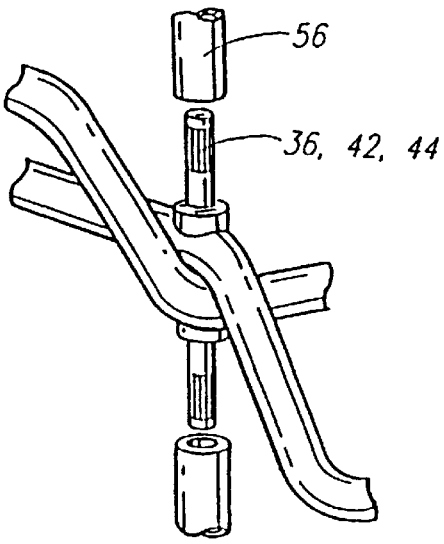
FIG. 5 is an enlarged, partially fragmentary, detailed view of contact areas for two stacked modular frames.
Figure 6:
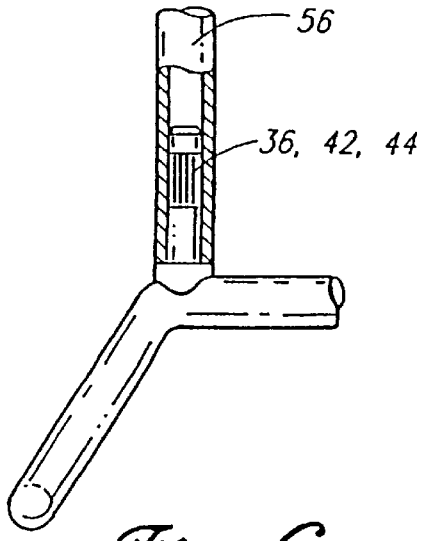
FIG. 6 is a sectional, partially fragmentary view of a support tube assembled to a modular frame.

The second modular frame 14 is constructed with an eye toward being restingly mounted onto the upper base 20 of a first modular frame 12 in a relatively stable configuration. The second frame lower base 40 should be constructed of geometry and dimensions identical to the first frame lower base 22 except that whereas two stub shafts 42 and 44 are located at bending points of one base side, the remaining two stub shafts 46 and 48 are positioned inwardly from the pair of bending points of the opposite side a predetermined distance L. The second frame upper base 50 is constructed identically to the first frame upper base 20 except that its sides 52 and 54 are of reduced length permitting assembly via vertical support tubes 56 having their lowermost ends received onto stub shafts 42–48, as further illustrated in FIGS. 5 and 6.

In a preferred embodiment, the lower base 22 of frame 12 has its bent end portions extending downwardly so that the frame 12 is resting on a ground plane solely on two opposite sides with the other two intervening sides being held spaced from the ground plane. On the other hand, the upper base 20 of frame 12 has its bent end portions extending upwardly away from the lower base 22. Similarly, the lower base for each modular frame 14 has its bent end portions extending downwardly while the upper base bent arm portions extend upwardly.

With reference once again to FIG. 2, there is depicted a single column 16 including a first modular frame 12 resting on a ground plane (not shown), and a further first frame 12' having its lower base resting on the upper base of frame 12. Also, it is to be noted that bent portions of the lower base of frame 12' extend downwardly and outwardly of the upper base for frame 12, while at the same time the bent end portions of the frame 12 upper base extend upwardly about the sides of the lower base of frame 12'. This arrangement results in a locking condition of the two frames against either relative rotation or relative translation of the frames, although the two frames may be readily lifted apart.

Finally, a second modular frame 14 is restingly located on the upper base of frame 12' in the same way as just described in connection with the assembly of frame 12' onto frame 12. In addition to the locking action against relative rotation and translation for the three-frame column of FIG. 2, since the uppermost frame 14 is of reduced cross-sectional dimensions, the columnar structure is more stable than if the dimensions were equal to those of the underlying frame.

Figure 4:
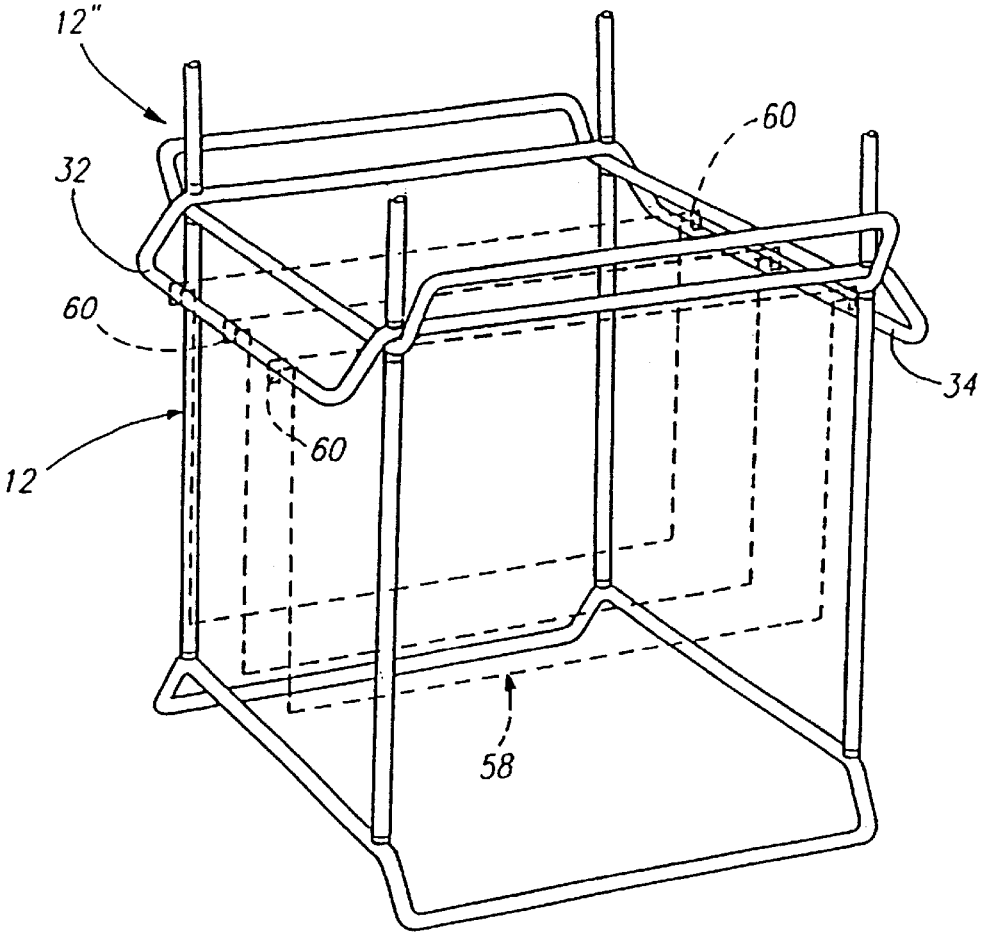
FIG. 4 shows in perspective, partially schematic, view utilization of a modular frame of this invention to support hanging files for documents.

FIG. 4 shows a pair of first modular frames 12 and 12" stacked in a column to be specifically used for maintaining hanging files 58. Hangers 60 on outer edges of the hanging files 58 hook onto the sides 32 and 34 of the lower base of an upper frame 12" and in that way locate files within the frame central space. File availability is primarily from the top with limited access from the sides.

Figure 7:
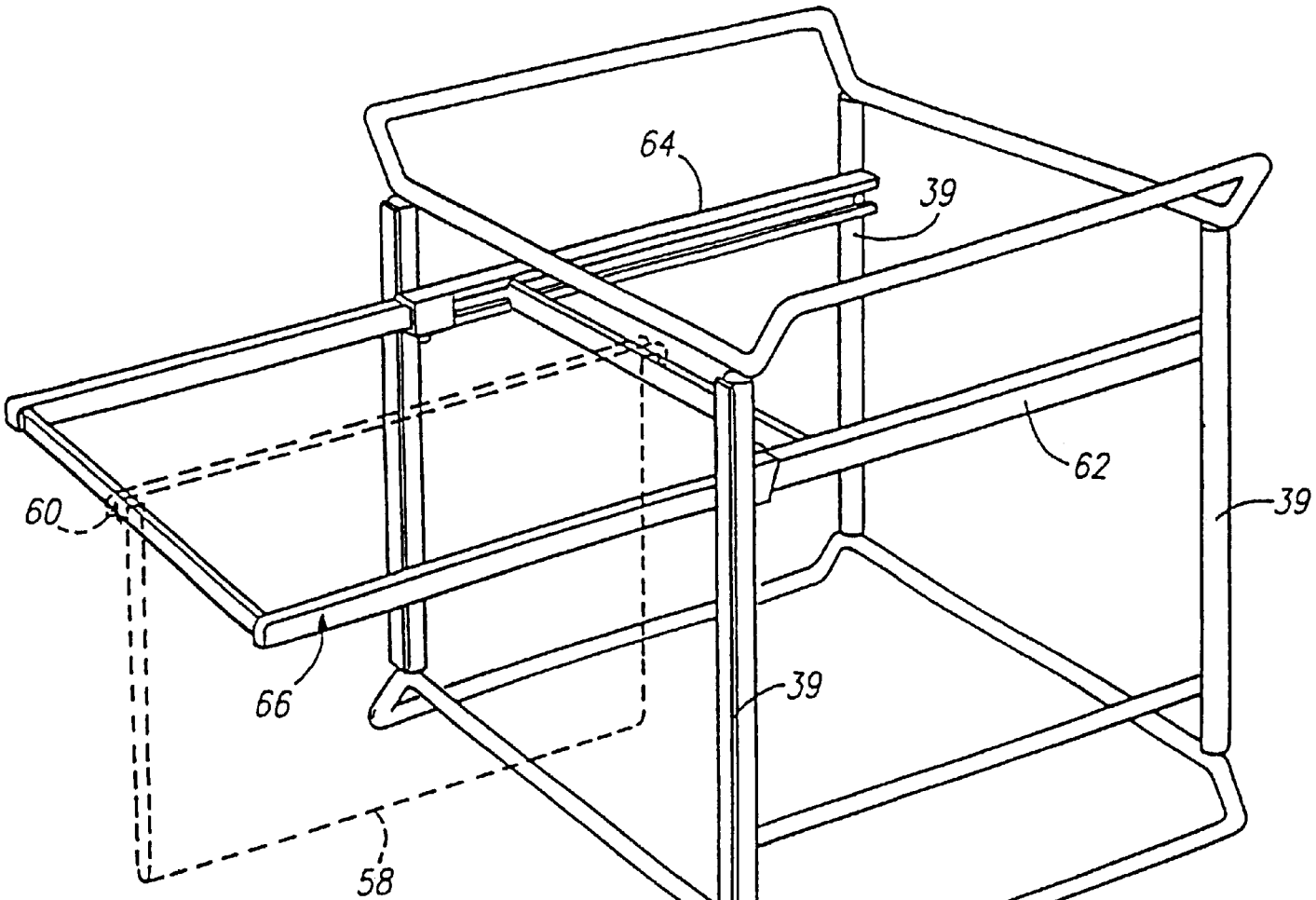
FIG. 7 is an isometric view of a modular frame utilized as a pull-out hanging file for documents.

FIG. 7 shows an alternative form of the system for accommodating hanging files 58, the latter being assumed identical to those hanging files depicted in FIG. 4 having edge hangers 60. In this version, first and second slide rails 62 and 64 are each secured to a pair of adjacent support tubes or rods 39 such that the two slide rails are parallel and spaced apart facing each other across the frame central space. An open center, generally rectangular carriage 66 is slidingly received within the rails 62 and 64 and is adjustable from a position fully within the frame central space, to a position substantially fully outside-frame 12 as shown in FIG. 7. The hangers 60 of each hanging file 58 hook onto opposite sides of carriage 66 as in the FIG. 4 embodiment.

Returning to FIG. 1, shelving elements 18, 18', 18" each consist of an elongated boardlike member of uniform thickness and width. When two first modular frames 12 and 12' are stacked on top of each other in a column the downwardly extending bent end portions of the lower base for 12' form a pair of aligned guide channels 67 and 68 through which a shelving element 18 can pass. Similarly, the shelving element can be received within guide channels in the further column 16'. Still further, the second modular frame 14 when stacked onto a first frame 12 or 12' provides similar guide channels for receiving shelving elements in the manner just described.

When it is desired to interrelate adjacent columns by a shelving element 18" extending at the level of the upper base of the uppermost frame (either 12 or 14), a further or third modular frame 70 is used. The latter frame is constructed of a single rod which has its ends welded together, and the so-formed closed loop is bent to provide a first pair of parallel sides 72 and 74 lying in one plane and a second pair of intervening parallel sides 76 and 78 lying in a common plane spaced from one side of the first plane. The third modular frame 70 is so dimensioned that when it is located on the upper base of a topmost frame 14 (e.g., FIG. 1) there are provided a pair of guide channels 80 and 82 for receiving a shelving element 18", for example.

Figure 8:
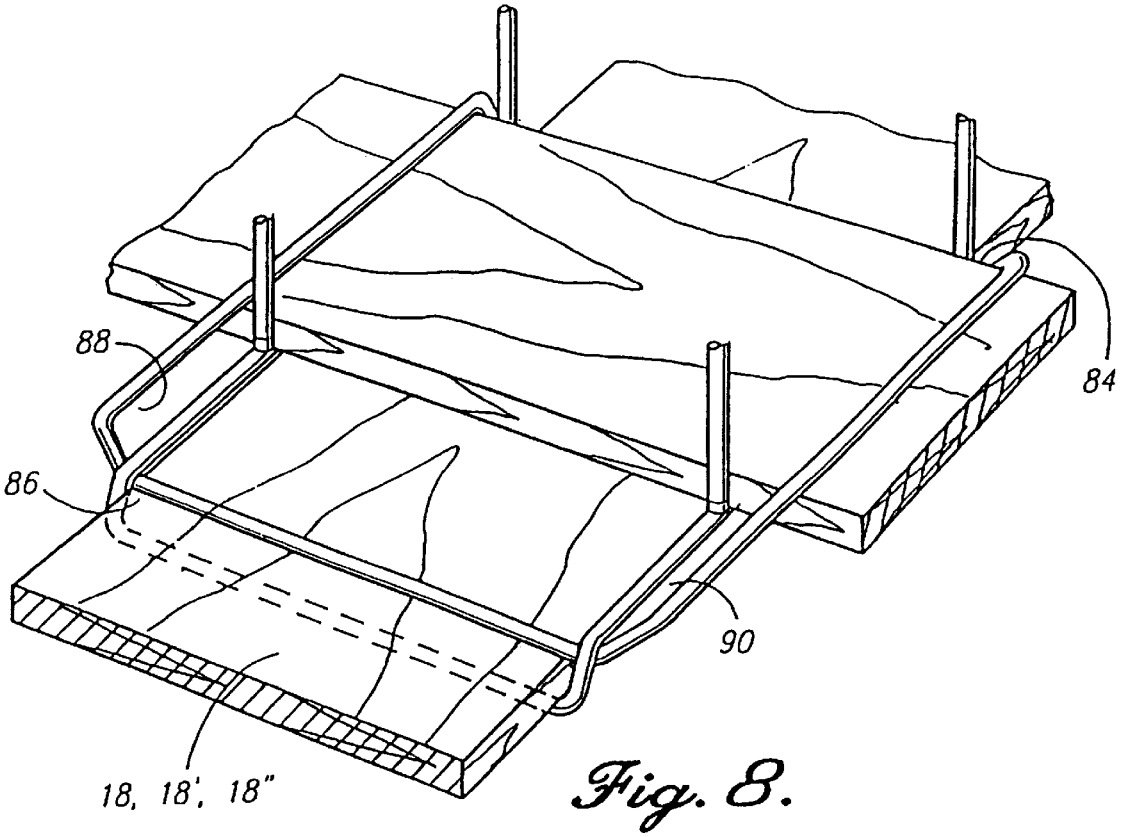
FIGS. 8, 9, and 10 depict isometric, first and second elevational views of shelving elements secured by and locking a pair of stacked modular frames together.
Figure 9:
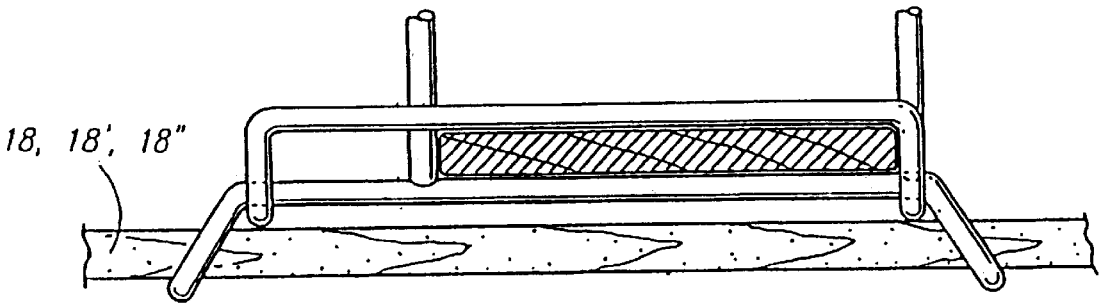
Figure 10:
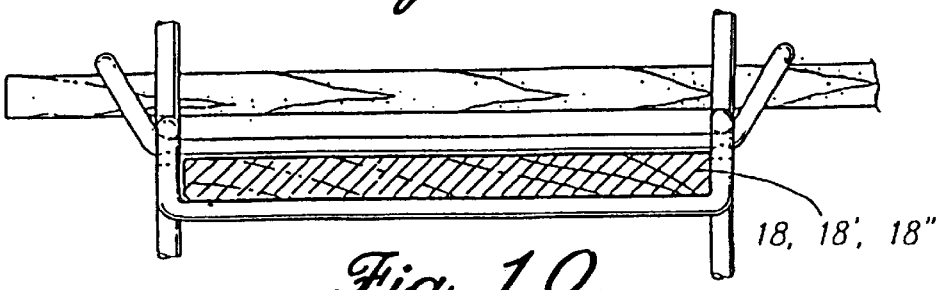

As shown in FIGS. 8–10, wherever a modular frame is assembled onto another modular frame there are two orthogonal sets of aligned guide channels which enable two vertically spaced shelving elements 18, 18', 18" to be secured to the assembled frames and extend at 90 degrees to each other. The pairs of channels are 84–86 and 88–90 (FIG. 8). This capability is especially advantageous where the described system must accommodate an inner corner of a room, for example, or it is otherwise desirable to provide an overall L-shape to the space system.

Figure 11:
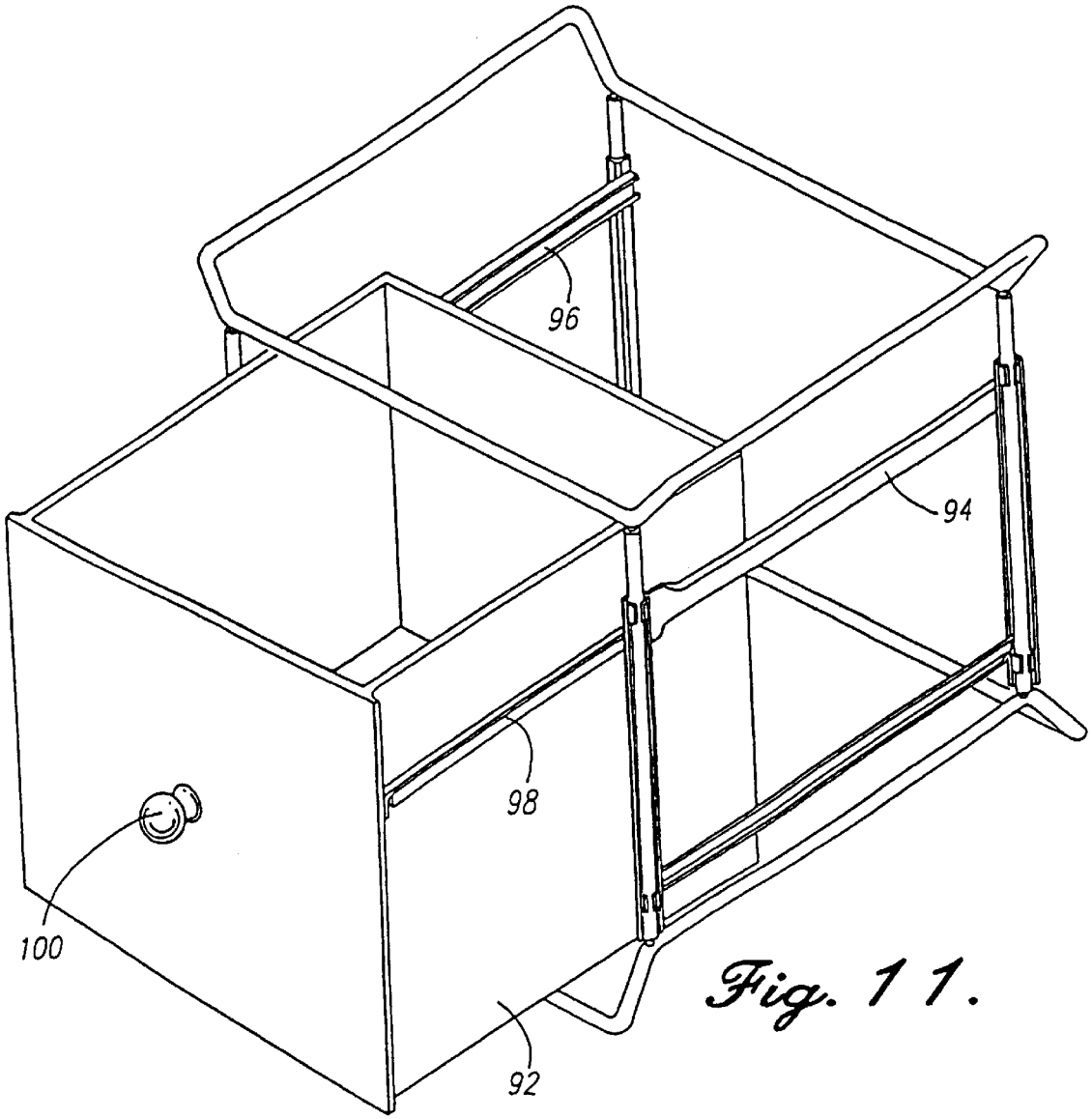
FIG. 11 is a perspective view of a modular frame adapted to include a drawer.

Turning now to FIG. 11 there is shown a first modular frame 12 modified to receive an open-top drawer 92 therein. More particularly, first and second slide rails 94 and 96 are secured to support tubes 39 on opposite sides of the frame which slidingly mate with respective slide inserts 98 on the two opposite outer sides of the drawer. The drawer may be slid into and out of the internal frame space by use of knob 100.

Figure 13:
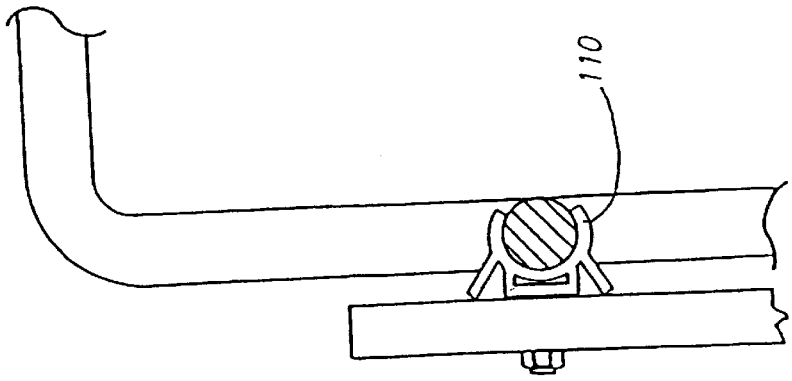
FIGS. 13, 14, and 15 depict elevational, partially sectional views of swinging door mounting. means for the compartment of FIG. 12.
Figure 12:
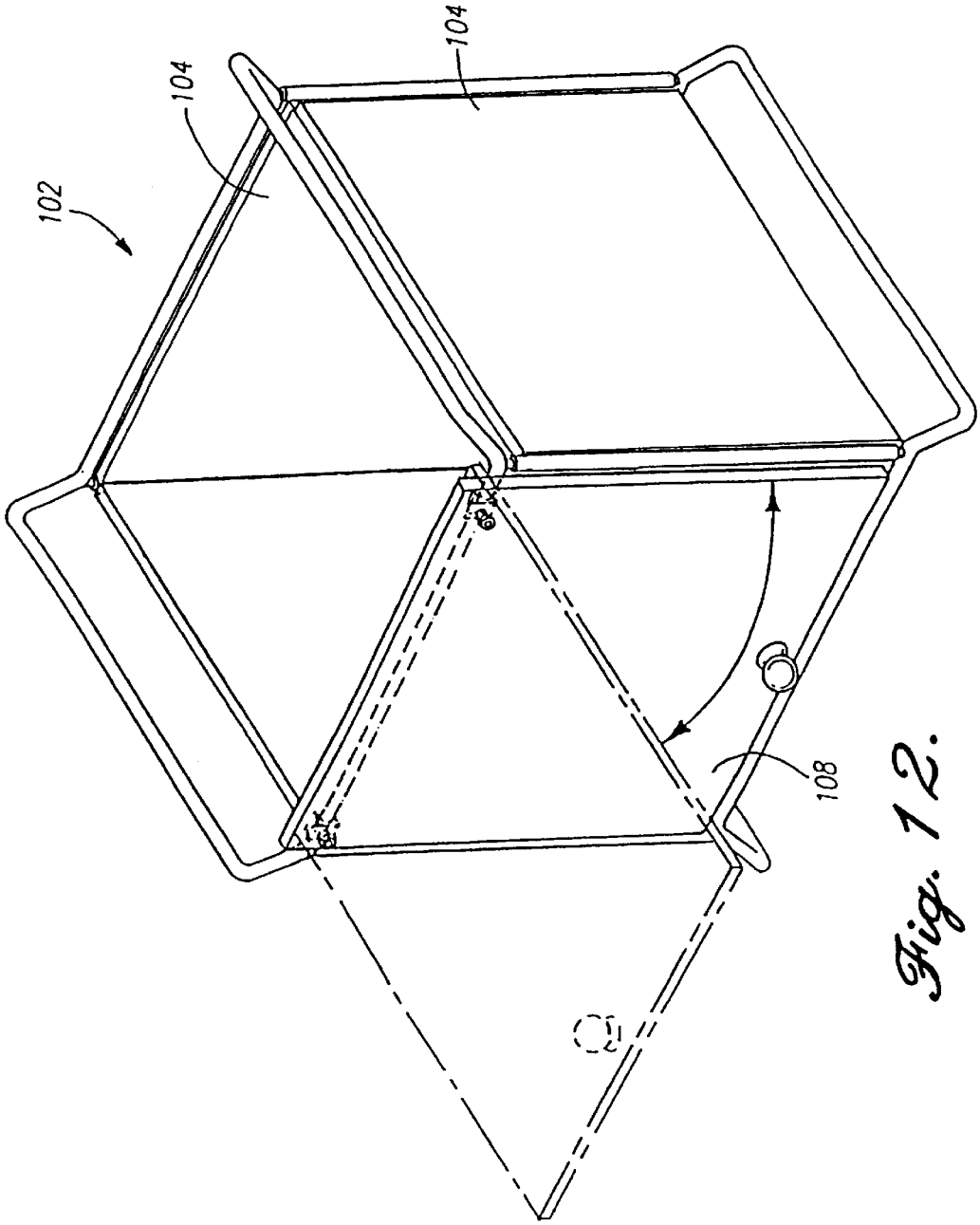
FIG. 12 is a perspective view of a modular frame adapted to provide a compartment with swinging-door access.
Figure 14:
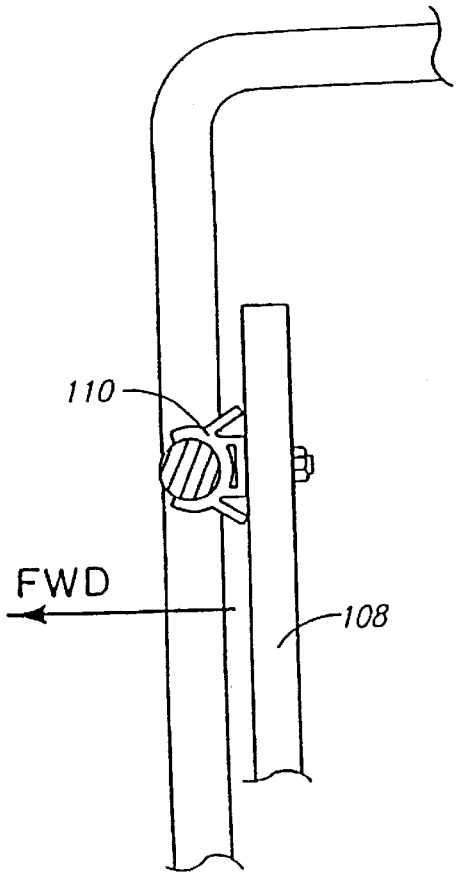
Figure 15:
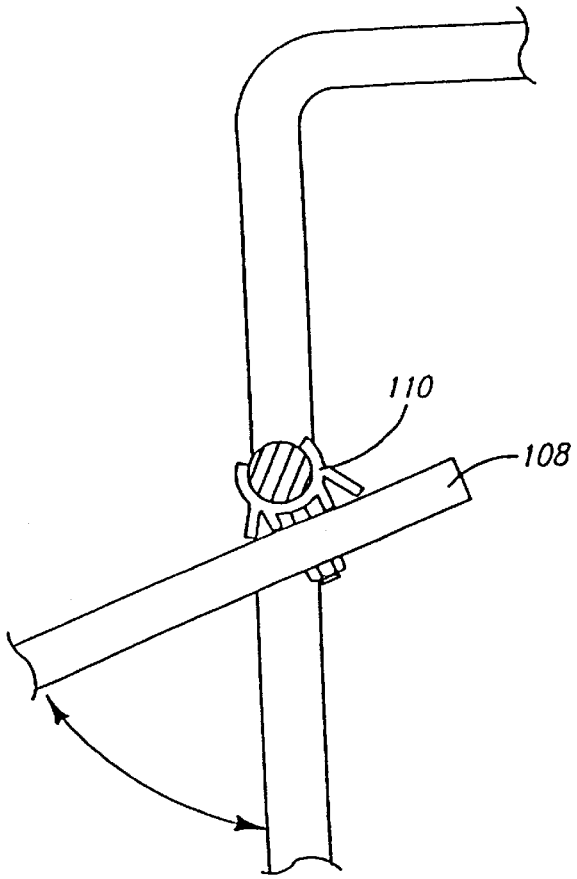

It may be desirable to utilize one or more modular frames as a closed compartment 102 as shown in FIG. 12. Sidewall 104 and bottom panels are removably secured to the base sides and support tubes by spring clips. The access side is closed off by a door 108 which is swingably mounted onto a modular frame upper base side by a pair of open-sided segmental spring clips 110. The clips may be either mounted on an inner surface of the door 108 (FIG. 13) or on its outwardly directed surface (FIGS. 14, 15).

Figure 16:
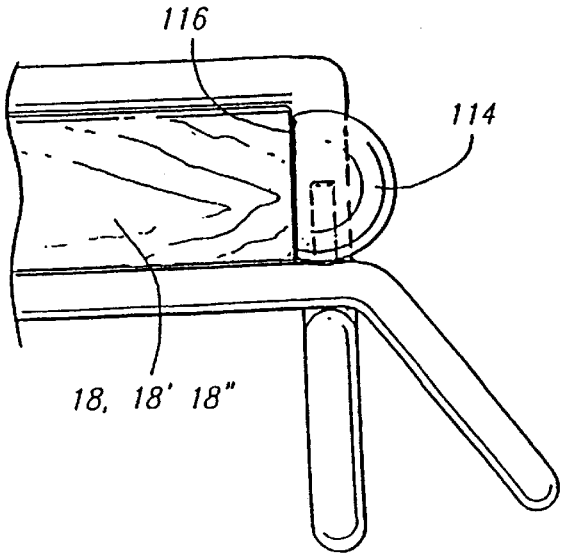
FIGS. 16 and 17 show in elevational view two forms of end finishings for receipt on the exposed end of a stub shaft.
Figure 17:
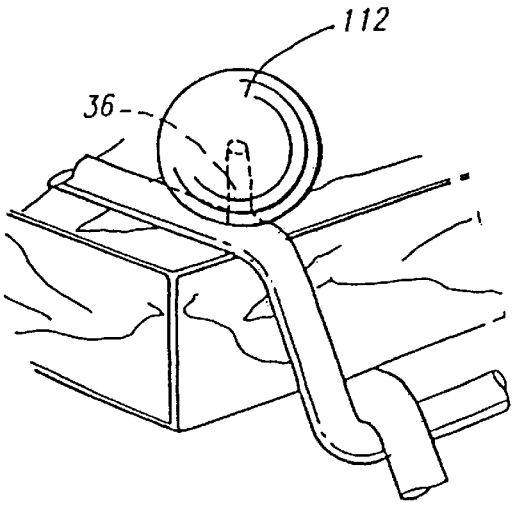

On reaching the topmost modular frame when building up a column of modular frames as described, there will be four upwardly extending stub shafts 36 left without associated support rods fitted thereon. FIG. 17 depicts a safety sphere 112 having an opening therein enabling fitting receipt onto the stub shaft. Where a shelving element 18, 18', 18" is located in obstructing relation so that a sphere 112 cannot be used, a sereispherical element 114 includes an opening for fitting receipt onto the stub shaf 36 with a flat side 116 facing toward the shelving element (FIG. 16).

Figure 18:
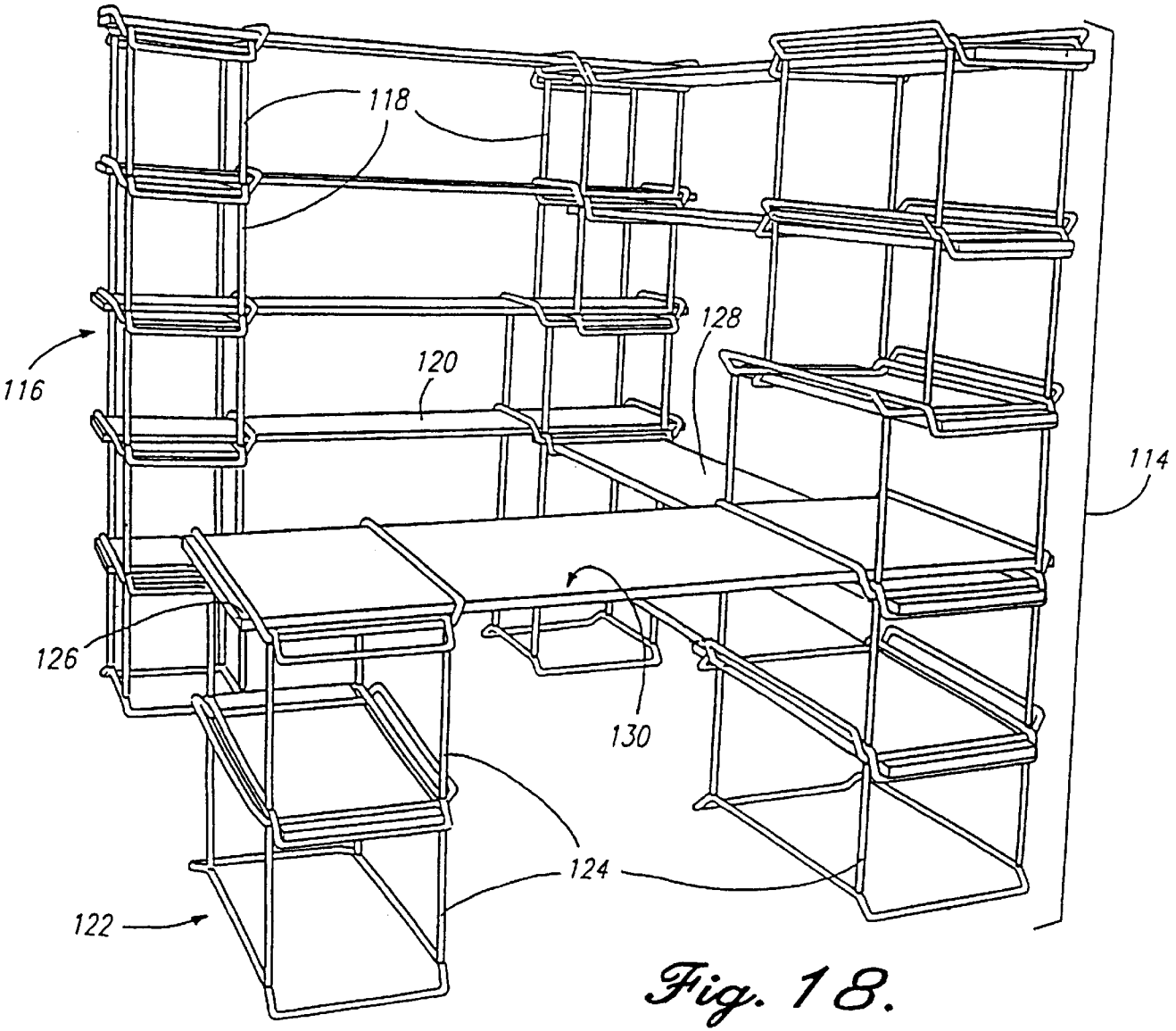
FIG. 18 is a perspective view of a system formed from individual columns of different dimensioned modular frames.

In the preceding description, it has been assumed that all modular frames 12 would be the same size. Also, although the modular frame 14 has an offset so that its cross-sectonal dimensions are specified as less than those of the frame 12, the frames 14 have only been presented to this point as of a fixed single size. It is advantageous to make these modular frames in different-sized sets so as to enhance flexibility particularly by using different size modular frames in the same system. By way of significant example, reference is made to FIG. 18 where a generally U-shaped system 114 is shown. More particularly, one arm 116 of the system is constructed of modular frames 118 which are dimensioned to support a shelving element 120 that is 12 inches wide; the other arm 122 is constructed of modular frames 124 dimensioned to handle shelving elements 126 which are 24 inches in width; and shelving elements 128 of medium width (e.g., 16 inches) interconnecting the two arms.

The larger modular frames 124 can be used to form a desktop or relatively large tabletop surface 130 in view of the wide shelving element 126. The well of the desk is formed by leaving a space between adjacent columns in arm 122. The first arm 116 having the narrowest shelving elements can accommodate smaller objects, while the medium shelving 128 will accommodate modest sized objects (e.g., television, computer monitor). The entire assemblage may be extended along a single wall, adjacent a comer forming an "L", or centrally located in a room providing 360 degree access.

Figure 19:
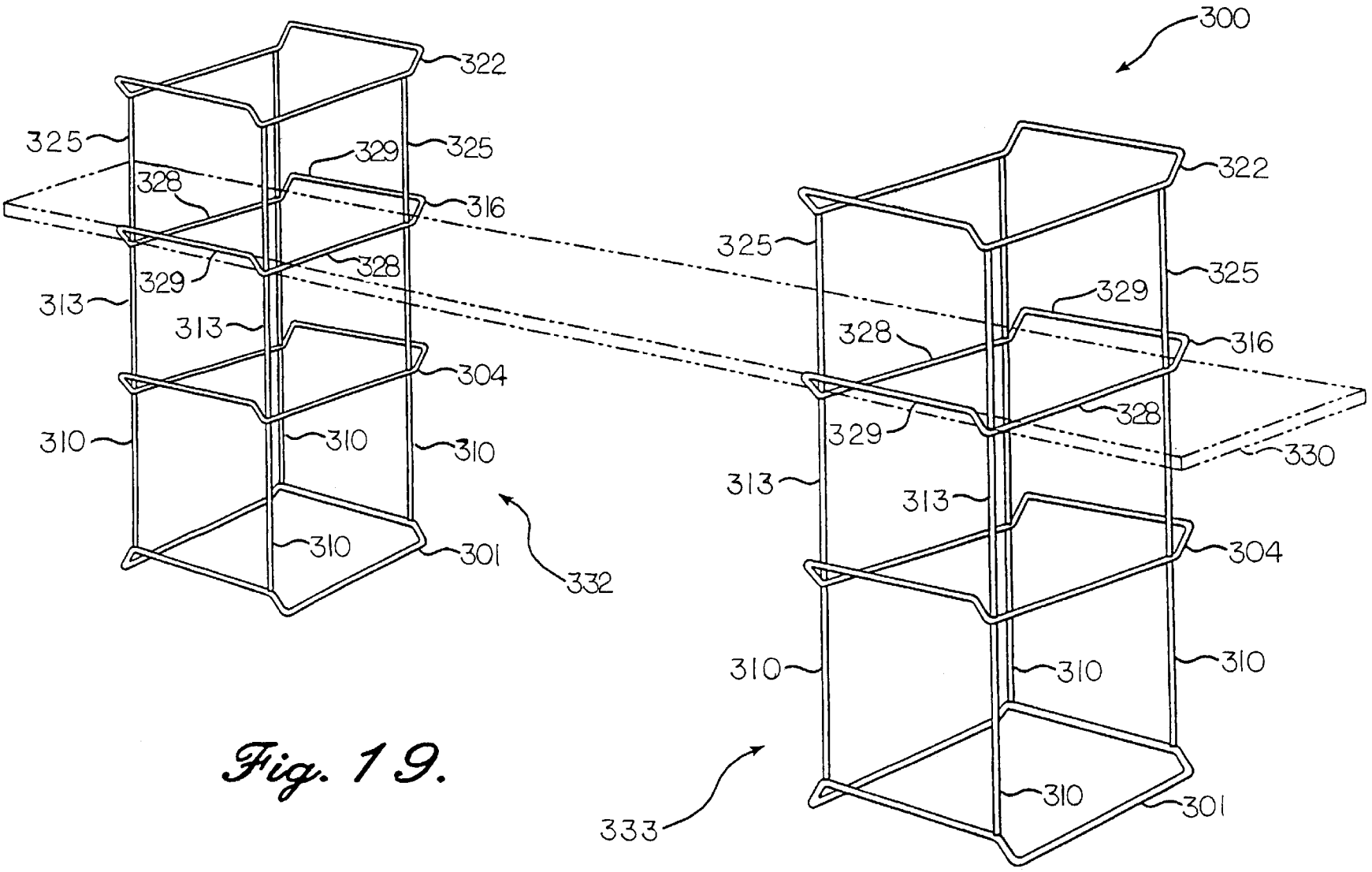
FIG. 19 is a front perspective view of an alternative embodiment of the present invention.
Figure 20:
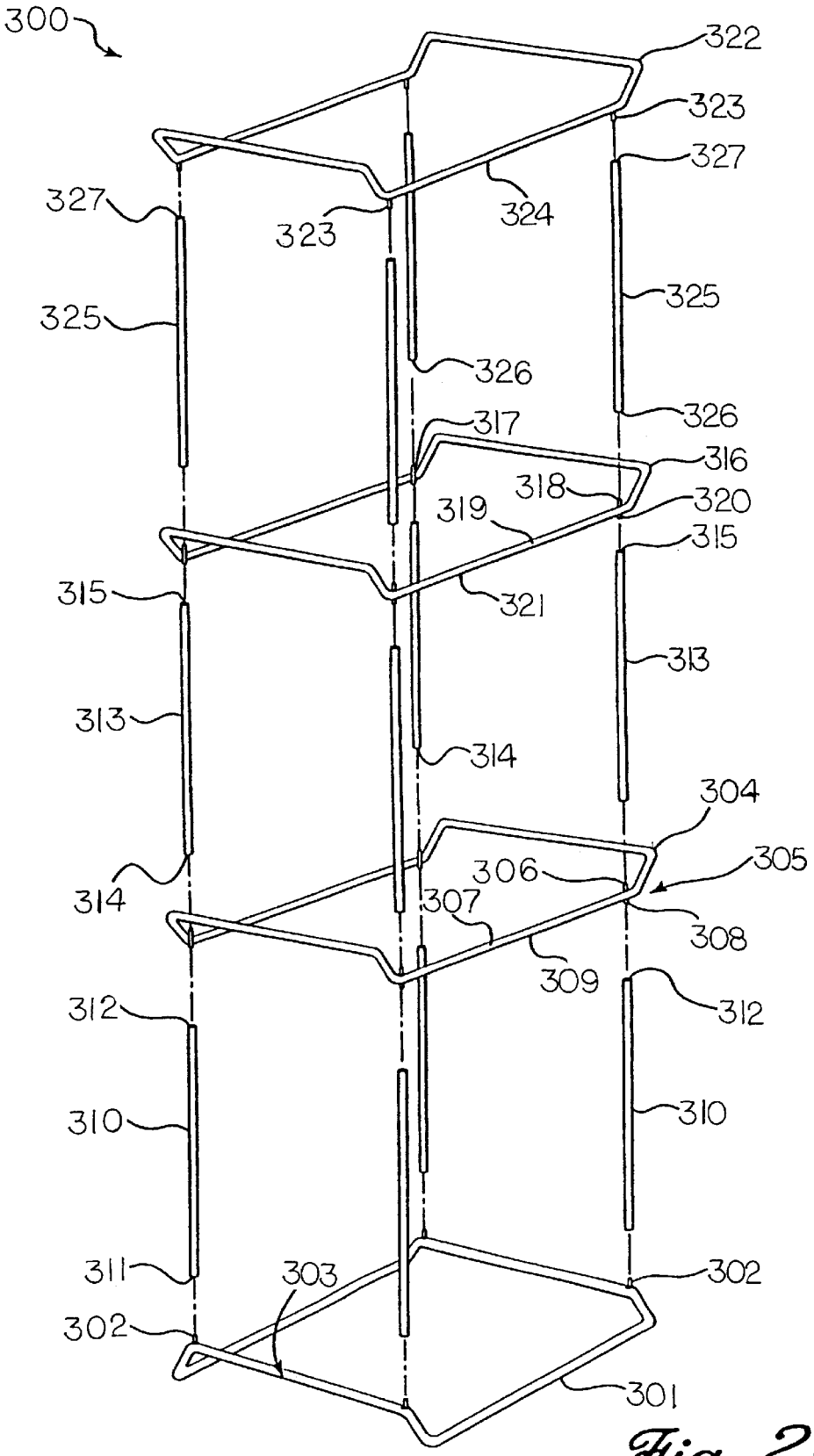
FIG. 20 is an exploded elevational view of the alternative embodiment illustrated in FIG. 19.
Figure 21:
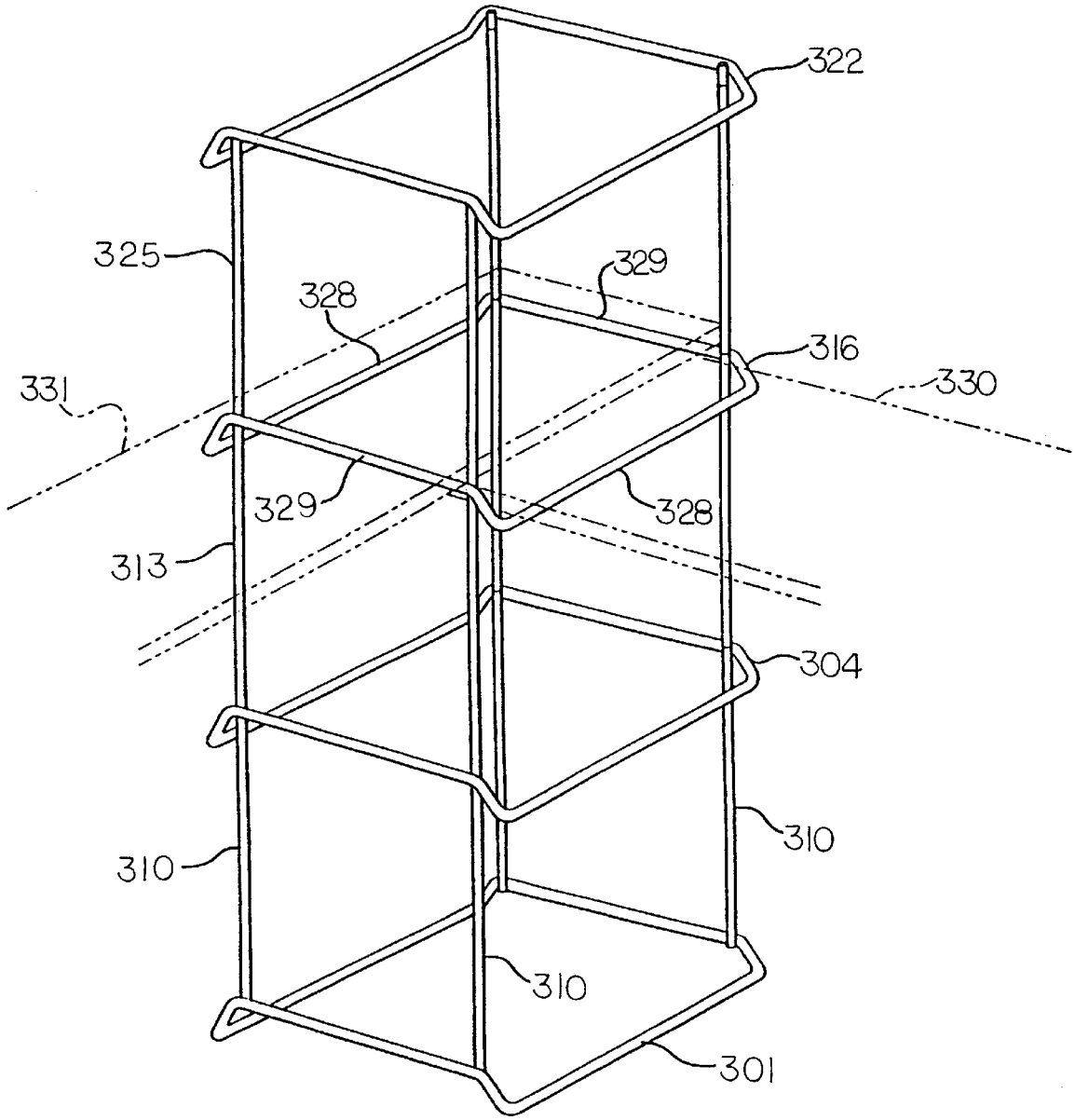
FIG. 21 is a perspective view of an alternative configuration of a preferred embodiment of the present invention.

In an alternative preferred embodiment of the present invention, as illustrated in FIGS. 19–21, a modular space system is provided having even greater flexibility of use, and reduced weight and cost. The space system is built up using single frames 301, 304, 316, and 322, coupled together and spaced longitudinally by spacers 310, 313, and 325. This is accomplished in accordance with a preferred embodiment of the present invention, as best seen in FIG. 20, by providing a first frame 301 having a plurality of first studs 302 extending above an upper surface 303 of the first frame 301. A second frame 304 is also provided, having a plurality of second studs 305. Each second stud 305 has a first portion 306 extending above an upper surface 307 of the second frame 304, and a second portion 308 extending below a lower surface 309 of the second frame 304. A plurality of first longitudinal spacers 310 couple the first lower frame 301 and the second frame 304 in longitudinally spaced relation to each other. The first longitudinal spacers 310 have a first open end 311 and a second open end 312, the first open end 311 receiving the first studs 302 and the second open end 312 of the spacers 310 receiving the second portion 308 of the second studs 305. By using a stud 305 that extends both above the upper surface of the frame and below a lower surface of the frame, it is possible to build both downward and upward from a single frame, without requiring the use of an additional frame.

A selected number of additional levels are built in a similar fashion. For purposes of illustration, as shown in FIGS. 19–21, and best seen in FIG. 20, a third frame 316 having a plurality of third studs 317 is coupled to the second frame 304 via a plurality of longitudinal spacers 313. Each of the third studs 317 has a first portion 318 extending above an upper surface 319 of the third frame, and a second portion 320 extending below a lower surface 321 of the third frame 316. Each of the second longitudinal spacers 313 has a first open end 314 and a second open end 315, the first open end 314 of the second longitudinal spacers receiving the first portion 306 of the second stud, and the second open end 315 of the second longitudinal spacers receiving the second end 320 of the third studs.

Although any desired number of levels may be built, in a preferred embodiment, a fourth frame 322 is provided, having a plurality of fourth studs 323 extending below a lower surface 324 of the fourth frame. A plurality of third longitudinal spacers 325 having a first open end 326 and a second open end 327 extend between the third frame 316 and the fourth frame 322. The first open end of the third longitudinal spacers 125 receive the first portion of the third studs 317, and the second open end 327 of the third longitudinal spacers 325 receive the fourth studs 323.

Therefore, if it is desired to only couple the frame to a longitudinal spacer in one direction, such as above the first lower frame 301 and below the fourth frame 322, the studs extend in only a single desired direction. However, when it is desirable to couple a frame both vertically upward and downward, the studs extend both above an upper surface and below a lower surface of the frame. Although the second studs 305 and the third studs 317 are illustrated as a single piece welded to an inner surface of their respective frames, it will be understood that the studs may be a single piece welded to an outer surface of the frames, or the studs may be two separate pieces, welded to the top and bottom surface of the frame, respectively.

As illustrated in FIG. 19, each of the first, second, third, and fourth frames 301, 304, 316, and 322 have a generally rectangular configuration, and have a first set 328 and second set 329 of parallel sides. When it is desired to create a work surface, for example at desk height, two columns 332 and 333 are constructed as described above. A board 330 having a selected width is placed on top of and supported by the upper surface of one of the sets of parallel sides of one of the first, second, third, and fourth frames. In the embodiment illustrated in FIG. 19, the board 330 is placed on the upper surface of parallel sides 328 of the third frame 316; The embodiment illustrated in FIGS. 19–21 has the advantage of providing a clean, unencumbered, continuous work surface along the length of the board, similar to a conventional table or desk given that the frame 316 extends beneath the board 330, and there is no second frame extending across the top of the board 330 as shown in the other preferred embodiments illustrated in FIGS. 1 18. In addition, as discussed above, it is still possible to continue building upward above the level of the work surface created by board 330.

The embodiment illustrated in FIGS. 19–21 provides additional advantages when space is extremely limited, for example in a closet or small bedroom. More particularly, when constructing the modular space system illustrated in FIG. 19, the second frame 304 is coupled to the first frame 301 by placing the first frame 301 on the ground, positioning longitudinal spacers 310 on the first studs 302, and placing the second frame 304 into the second open ends 312 of the spacers 310. The system is further built up by placing longitudinal spacers 313 on the second studs 305 and positioning the third studs 317 of the third frame 316 in the second open end of the second spacers 313. The board 330 is then placed on top of the third frame 316, and the construction of the space system is continued by placing the third longitudinal spacers 325 onto the third studs 317, and building as many additional levels as is desired, by alternating longitudinal spacers and frames. By providing a system in accordance with this preferred embodiment of the present invention, the board 330 is placed directly on top of a frame, rather than being threaded through a guide channel created by two sets of stacked interlocking frames. It is therefore possible to build a space system in a confined area, where there would otherwise be insufficient space to maneuver the board sufficiently to insert it into a guide channel.

As further illustrated in FIG. 21, it is also possible to support two boards 330 and 331 by a single frame. A first board 330 is positioned on top of and supported by a first set of parallel sides 328 of one of the frames, for example frame 316. The second board is placed on top of and supported by the second set of parallel sides 329 of the same frame. In this manner, a corner unit is created that supports two boards, without requiring a frame to extend across a top surface of either of the boards. In this way, the complexity, and in turn the cost and weight of the system is reduced, while increasing the useable surface area and flexibility of the system. To further simplify manufacturing, the frames may be a flat square or rectangle, without having parallel sides bent upward or downward.

In an alternative preferred embodiment, as illustrated in FIGS. 22–30, a modular space system 199 is provided, constructed in a similar manner to the space systems discussed above. (Throughout the discussion of FIGS. 22–30, elements that are identical to elements found in FIGS. 19–21 will be identified with the same reference numerals as used in FIGS. 19–21.) As illustrated in FIGS. 22–27, a first lower frame 301 having a plurality of first studs 302 extending above an upper surface of the first lower frame 301 is positioned on a support surface, for example, the floor. A plurality of posts 200 extend longitudinally between the first lower frame 301 and a second frame 304 spaced from and aligned in parallel relationship to the first frame 301. As described previously and as seen in FIG. 28, second frame 304 has a plurality of second studs 305, each second stud 305 having a first portion 306 that extends above an upper surface of the second frame 304 and a second portion 308 extending below a lower surface of the second frame 304.

Figure 28:
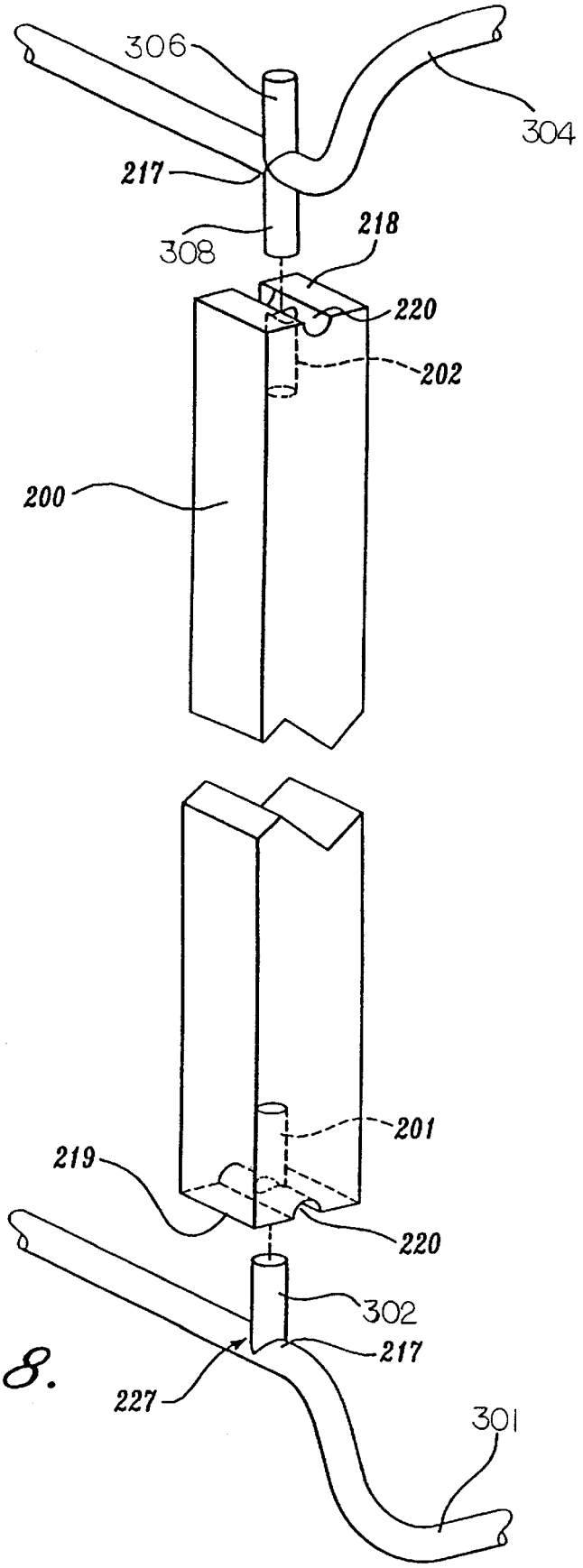
FIG. 28 is a partially exploded elevational view of a post and frames provided in accordance with a preferred embodiment of the present invention.
Figure 29:
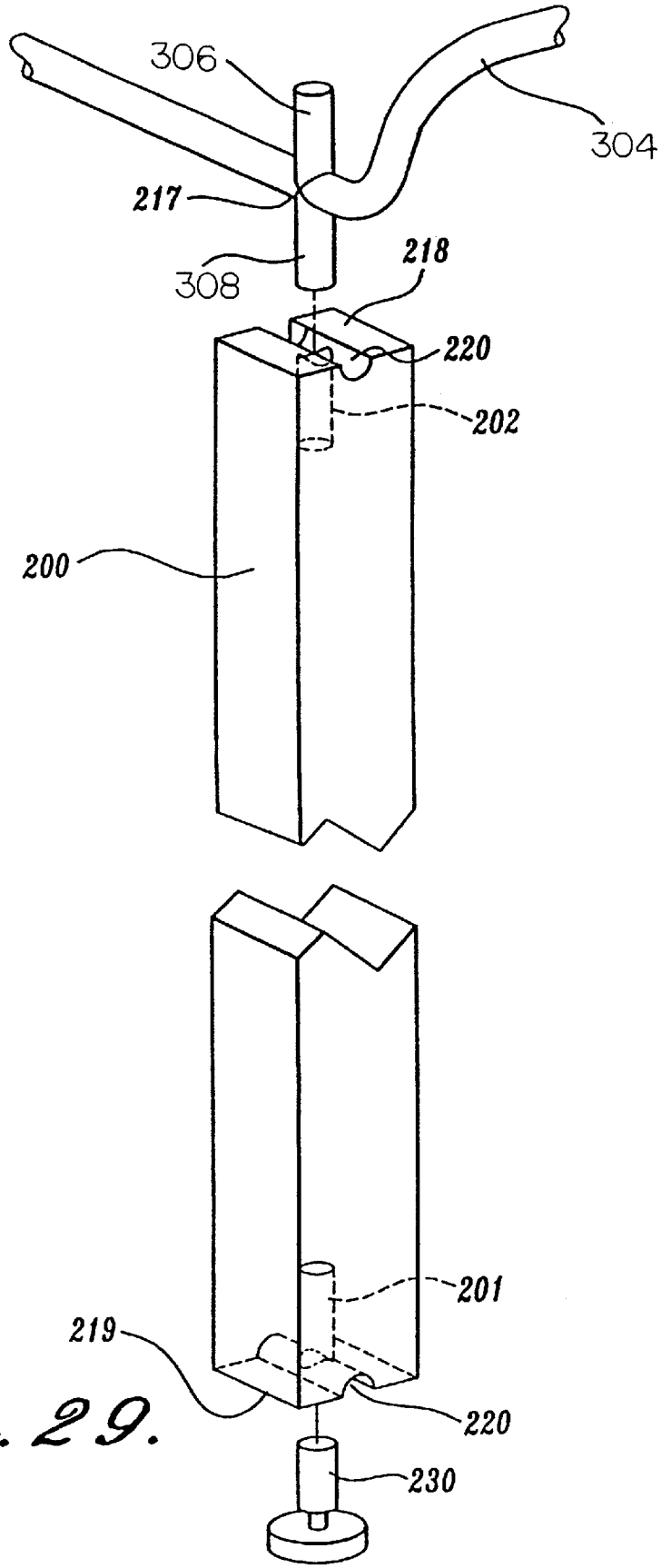
FIG. 29 is a partially exploded elevational view of a post, frame, and support assembly provided in accordance with a preferred embodiment of the present invention.

As seen, for example in FIG. 28, each of the posts 200 has a first bore or open end 201 provided in a bottom surface 219 of the post to receive one of the first studs 302. Each of the posts 200 is further provided with a second bore or open end 202 provided in a top surface 218 to receive one of the second portions 308 of the second studs 305. In this manner, the plurality of posts 200 couple the first lower frame 301 and the second frame 304 in longitudinally spaced relation to each other. The lower frame 301 therefore forms a support assembly 227 for the space system 199. Alternatively, as illustrated in FIG. 29, the support assembly 227 comprises a plurality of adjustable feet 230 that are received and retained by the bores provided in the bottom of the posts.

It should be noted that each of the first and second frames 301, 304 has a substantially tubular outer surface 217. To further facilitate the coupling of the two frames, each of the posts 200 is provided with a groove 220 in both the top surface 218 and bottom surface 219 of the post. Each of the grooves 220 has a curvature to matingly engage the tubular outer surface 217 of the first and second frames 301, 304.

Figure 24:
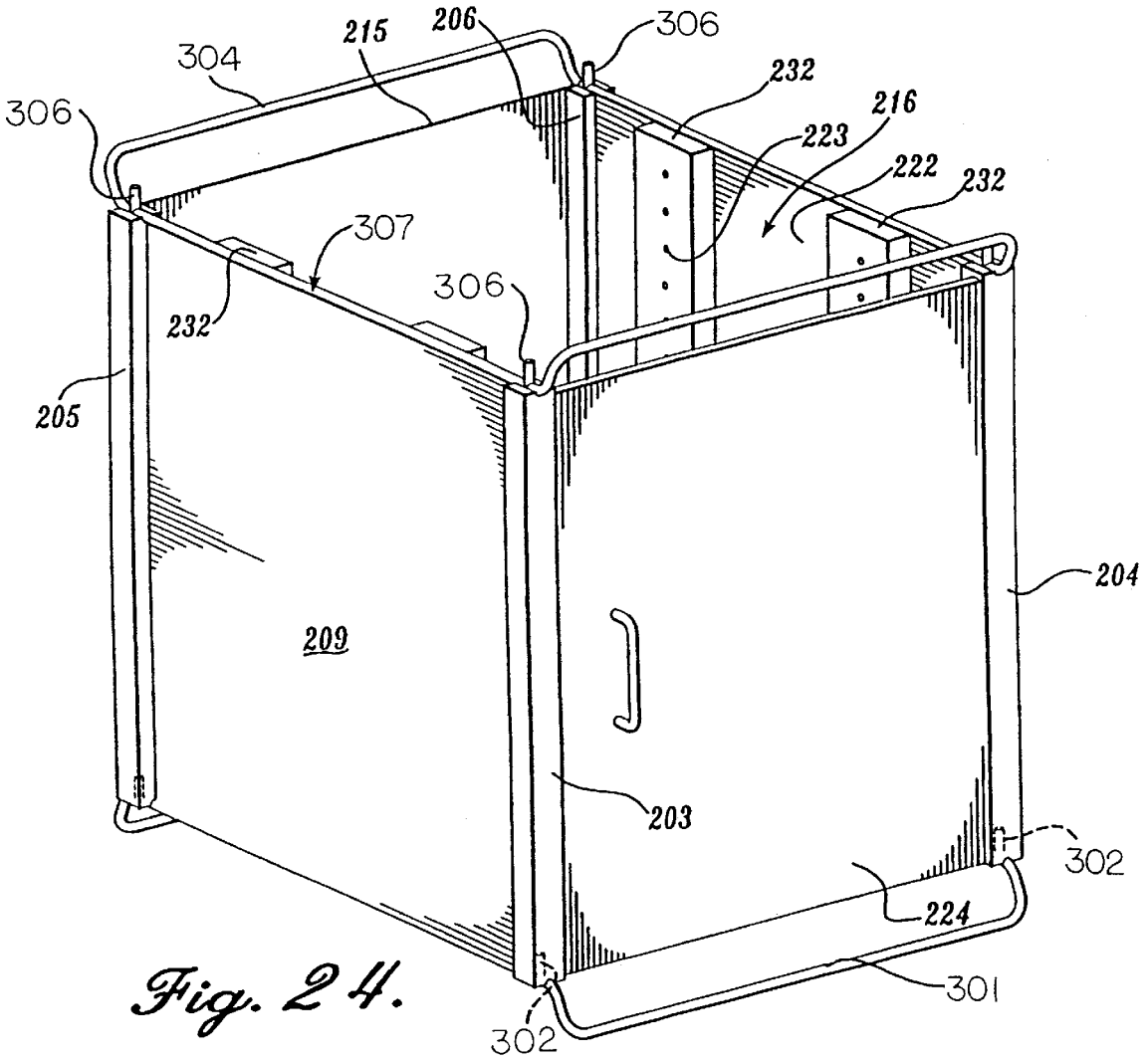
FIG. 24 is a front perspective view of an enclosure provided in accordance with a preferred embodiment of the present invention.
Figure 25:
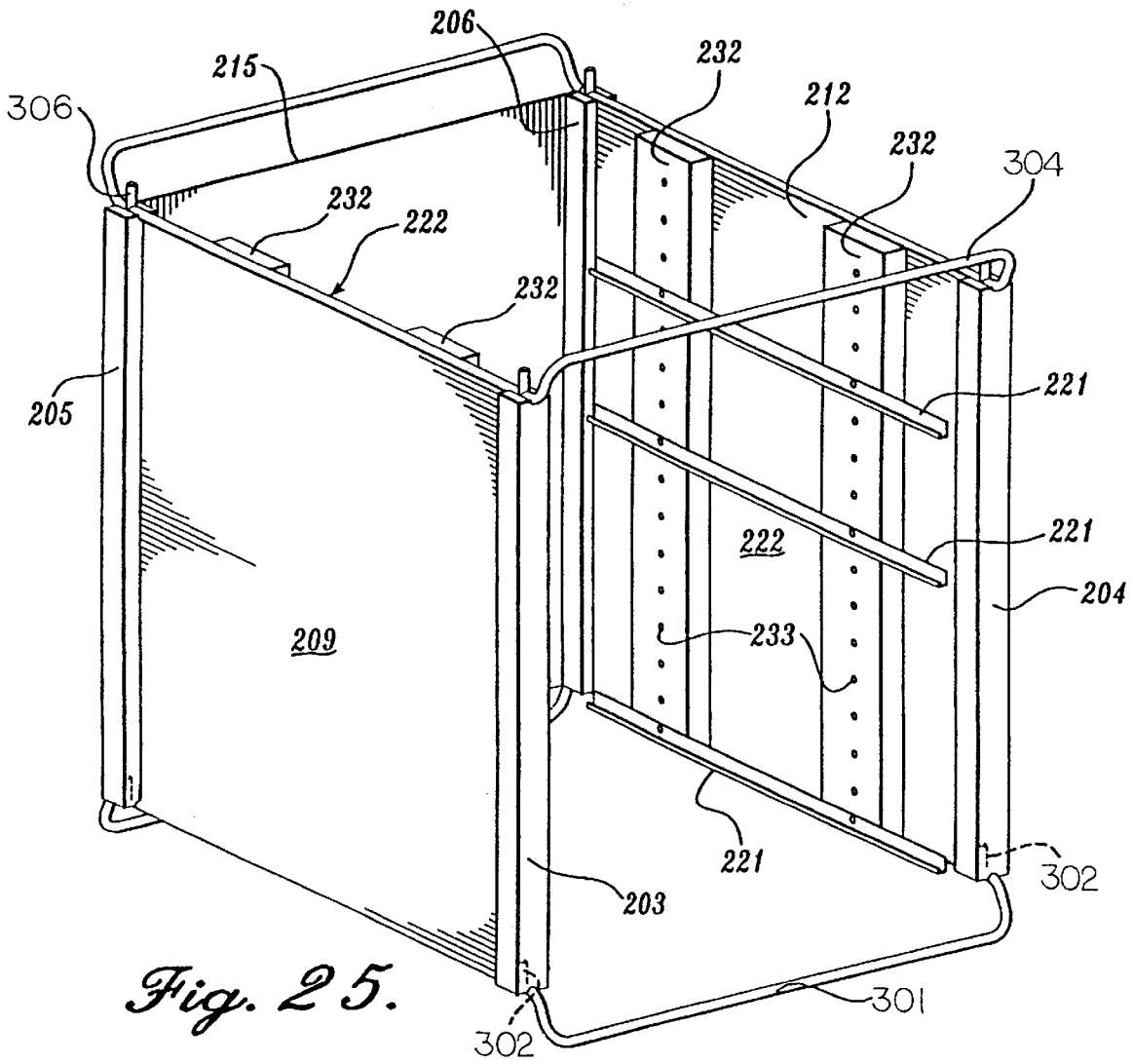
FIG. 25 is a front perspective view of an enclosure provided in accordance with the present invention.
Figure 26:
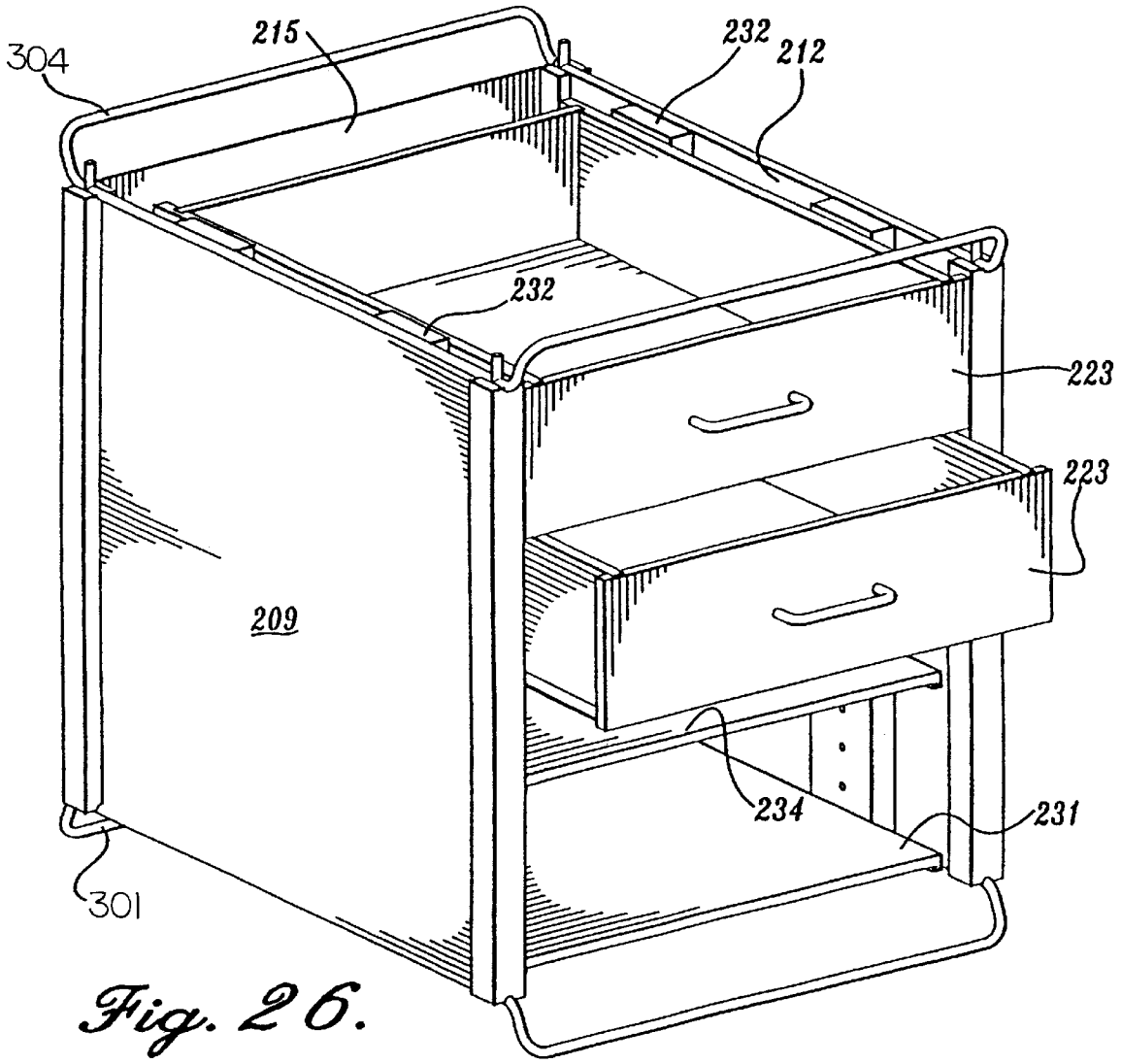
FIG. 26 is a front perspective view of the enclosure shown in FIG. 25 further including a set of drawers.
Figure 30:
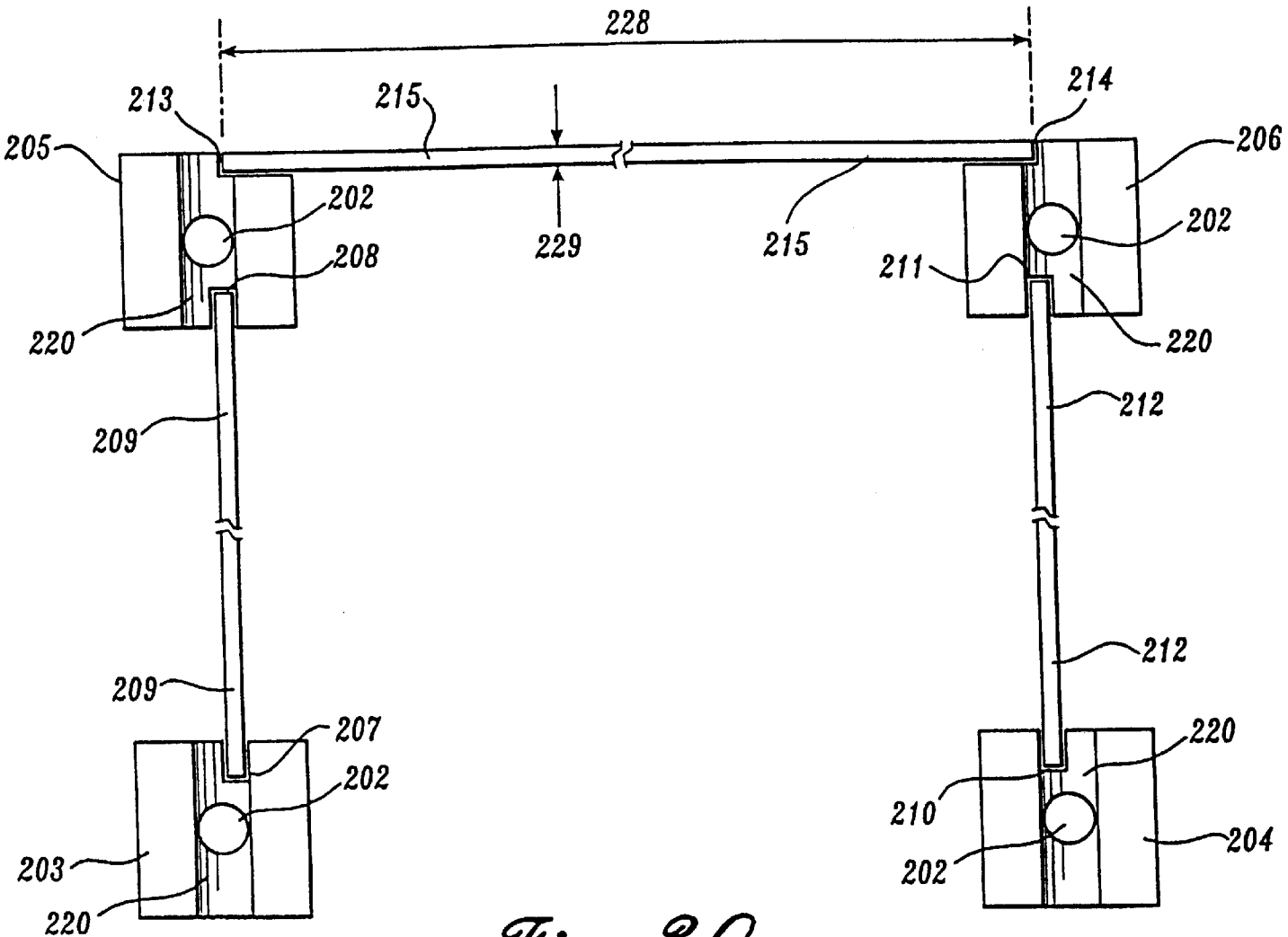
FIG. 30 is a top plan view of posts and planar members provided in accordance with a preferred embodiment of the present invention.

In a preferred embodiment, as best seen in FIG. 30, and as also seen in FIGS. 24–26, the plurality of posts 200 include a first forward post 203 and a second forward post 204 spaced laterally from each other, and a first rearward post 205 and a second rearward post 206 spaced laterally from each other and from the first and second forward posts 203, 204. The first forward post 203 has a first slot 207 aligned with a second slot 208 provided in the first rearward post 205. A first planar member 209 is received by and extends between the first and second slots 207, 208. Similarly, a third slot 210 provided in the second forward post 204 is aligned with a fourth slot 211 provided in the second rearward post 206. A second planar member 212 is received by and extends between the third and fourth slots 210, 211. The first rearward post 205 is further provided with a fifth slot 213 and the second rearward post 206 is further provided with a sixth slot 214 aligned with fifth slot 213. A third planar member 215 is received by and extends between the fifth and sixth slots 213, 214. In this manner, as best seen in FIGS. 25 and 30, the first, second, and third planer members 209, 212, 215 form three sides of a substantially parallelogram-shaped enclosure 216.

Figure 27:
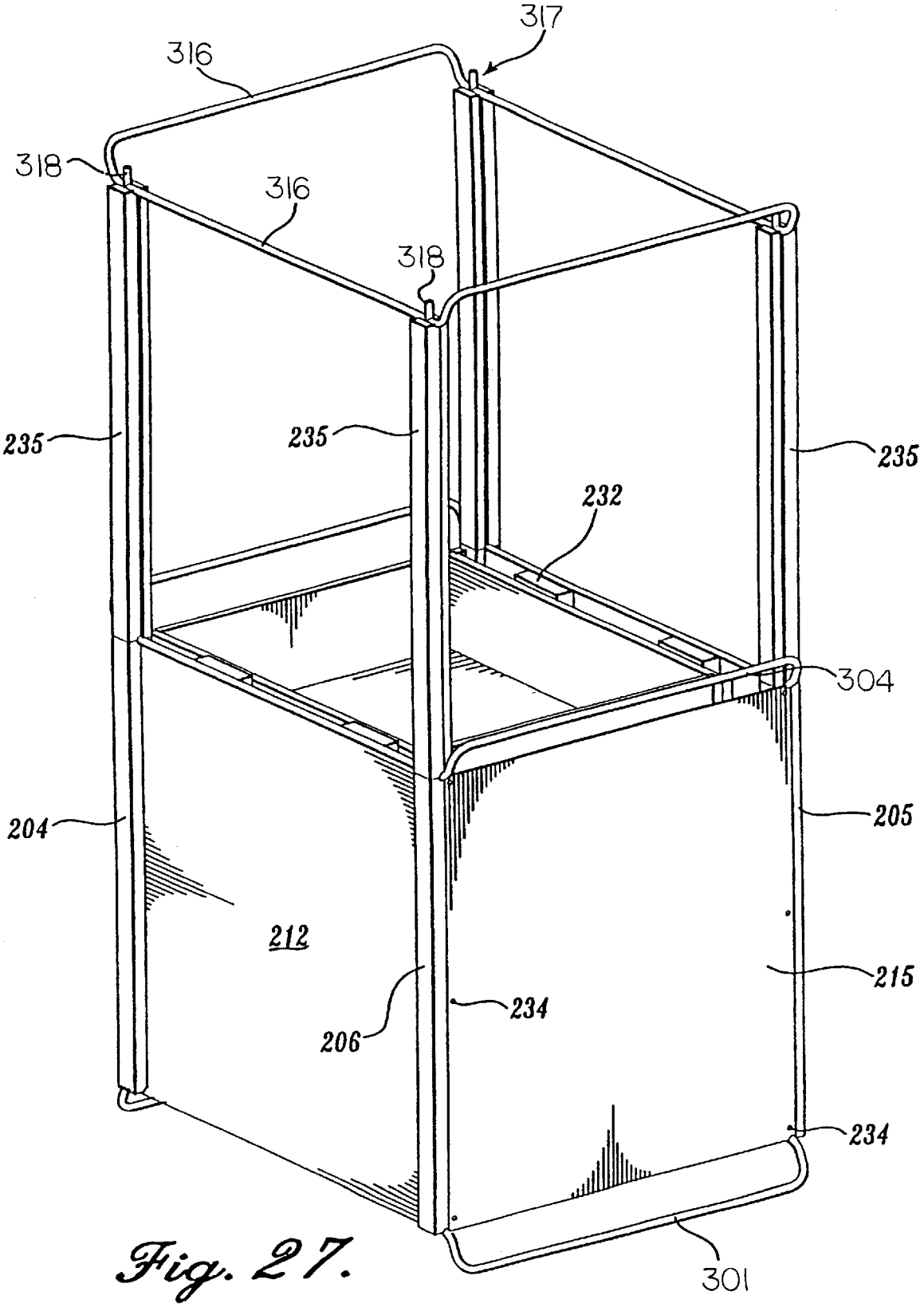
FIG. 27 is a rear perspective view of the enclosure shown in FIG. 26, further including additional elements of a space system provided in accordance with the present invention.

As best seen in FIGS. 27 and 30, the third planar member 215 has a selected width 228 and thickness 229 to be substantially flush with the rear surface of the rearward posts 205, 206 when the third planar member 215 is positioned in the fifth and sixth slots 213, 214. The third planar member 215 is then secured to the rearward posts 205, 206 via screws 234 or other similar fasteners. It will be understood that alternatively, the fifth and sixth slots 213, 214 could be formed to each encompass three sides of the third planar member 215 similar to the first-fourth slots, resulting in the third planer member 215 not being flush with a rear surface of the rearward posts 205, 206.

As best seen in FIGS. 24–26, a plurality of supports 232 are coupled to an inner surface 222 of each of the first and second planar members 209, 212. A plurality of holes 233 are spaced evenly along the length of each support 232. A plurality of gliders or rails 221 may therefore be coupled at any of the plurality of locations provided by the holes 233, for example, via screws or other fasteners. The user may therefore configure the enclosure 216 to accommodate a selected number of drawers 223, shelves 231, 234, or a combination thereof, as best seen in FIG. 26. If it is desired to provide the enclosure 216 with drawers 223, conventional drawers are used having edges that slidingly engage gliders 221.

Alternatively, as illustrated in FIG. 24, a door 224 is pivotally coupled to opposing surfaces of the first and second forward posts 203, 204 to selectively allow access to the enclosure 216. The enclosure 216 may therefore function as a cupboard, or may be provided with a plurality of shelves. In a preferred embodiment, where the enclosure 216 is supported by adjustable feet 230, a fourth planar member 231 extends between a lower region of each of the first, second, and third planer members 209, 212, 215 to provide a substantially horizontal support surface, as best seen in FIG. 26. The use of a fourth planar member 231 also provides additional rigidity, which may be particularly desirable if the support assembly 227 comprises adjustable feet 230 rather than first lower frame 301.

The end user may therefore be provided with planer members 209, 212, 215 and posts 200 to be assembled by simply inserting the planer members into the first-sixth slots of the posts. Alternatively, the end user may be provided with a pre-assembled first side comprising the first planer member 209 inserted into the first and second slots 207, 208, and with a second pre-assembled side comprising the second planar member 212 already inserted into the fourth and fifth slots 211, 213. The end user would then simply attach the third planer member 215 in the fifth and sixth slots 213, 214; position the three sides of the enclosure 216 onto a support assembly comprising either a lower frame 301 or a plurality of adjustable feet 230; and configure the interior of the enclosure with gliders 221 at selected locations to receive either drawers 223 or shelves 234, and/or a door 224, as desired.

Figure 22:
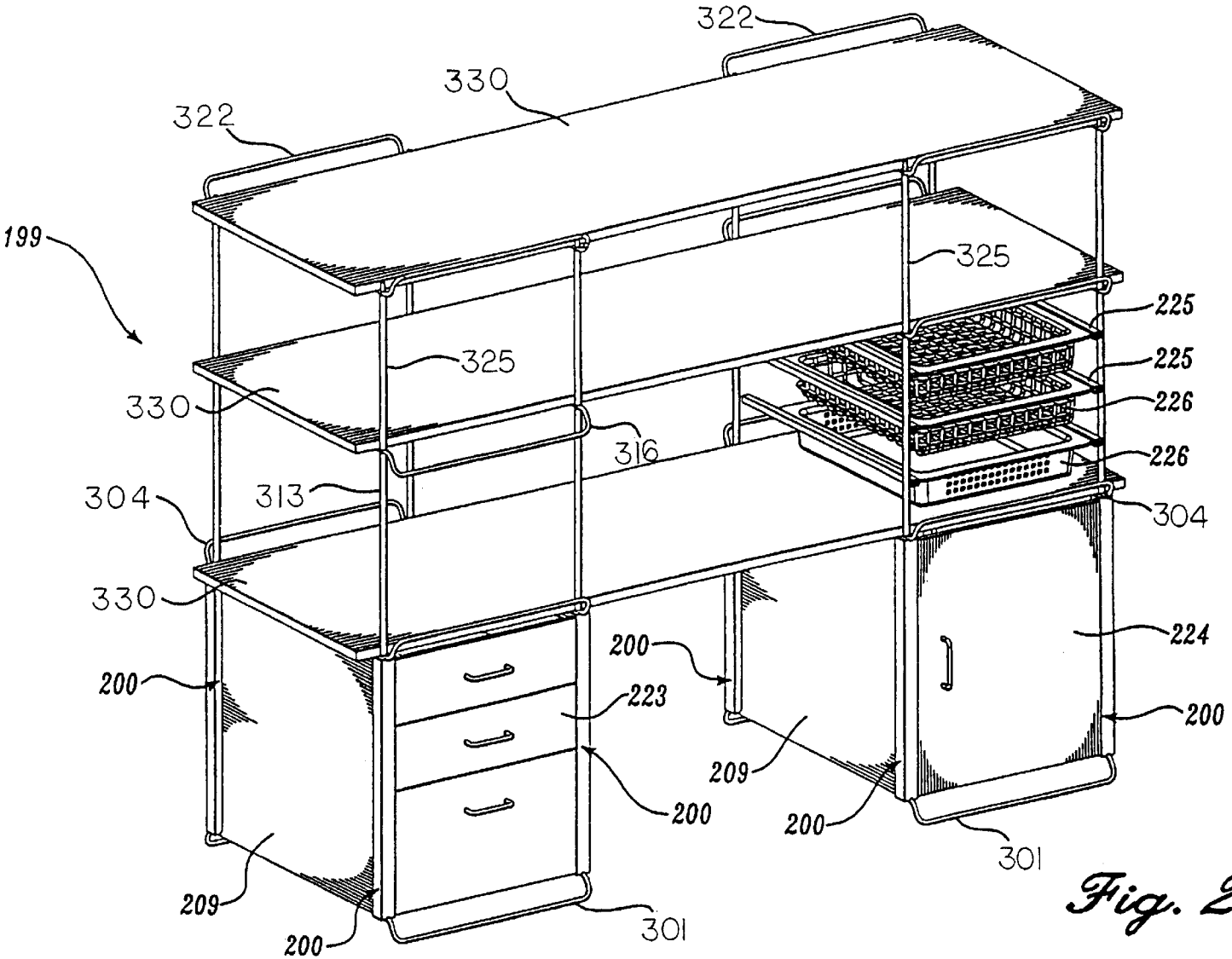
FIG. 22 is a front perspective view of a space system provided in accordance with a preferred embodiment of the present invention, with enclosed lower units;.
Figure 23:
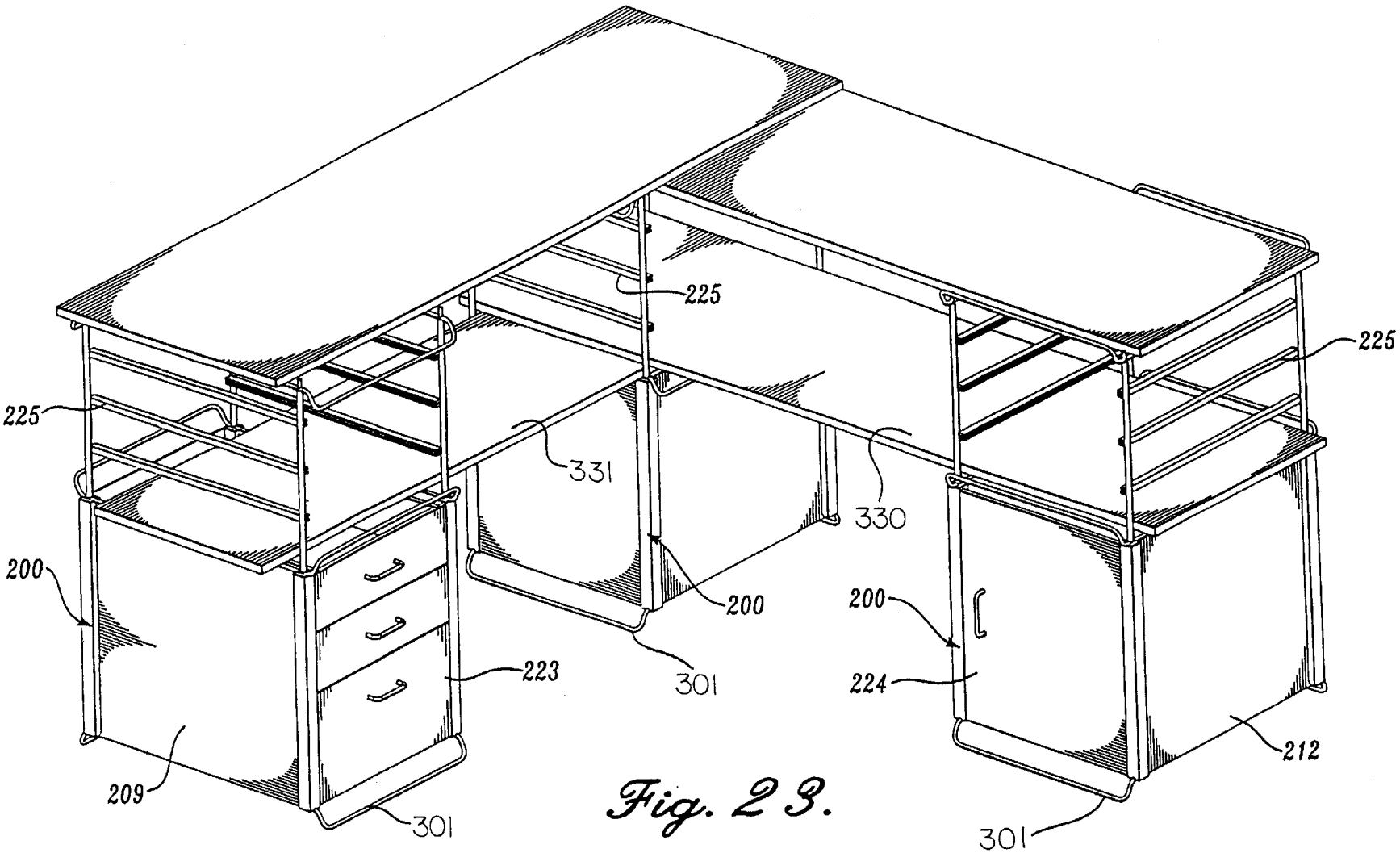
FIG. 23 is a perspective view of an alternative configuration of a space system provided in accordance with a preferred embodiment of the present invention.

As best seen in FIGS. 22 and 23, and as described above with respect to FIGS. 19–21, the modular space system is built up to have a selected number of levels using longitudinal spacers and additional frames. Two columns assembled in this manner may be coupled together via a board 330 extending therebetween, to provide a horizontal work surface.

For example, it may be desirable to build an enclosure having a set of drawers 223 in the manner described above, and a second enclosure having a cabinet enclosed by a door 224, in the manner described above. These two enclosures may then be built into two columns using longitudinal spacers 313, 325 and additional frames 316, 322, the two columns being joined by a board 330. Alternatively, an L-shaped space system may be formed by joining more than two columns together with boards, as illustrated in FIG. 23, and as described above with respect to FIGS. 19–21.

In an alternate embodiment, as illustrated in FIG. 27, the second frame 304 may be joined in longitudinally spaced relation to third frame 316 via a second plurality of posts 235, each post 235 having the same configuration as the posts 200. As described above, the third frame 316 has a plurality of third studs 317 having a first portion 318 extending above an upper surface of the third frame 316 and a second portion extending downward into the top bore of each of the second posts 235. Because each of the grooves 220 provided in a top and bottom surface of each of the posts matingly engages one-half of the circumference of the tubular outer surface 217 of the frames, the second plurality of posts 235 may be stacked on the first plurality of posts to create a flush, solid appearance between the two sets of posts.

In a preferred embodiment, as further illustrated in FIGS. 22 and 23, a plurality of tracks 225 are coupled to the longitudinal spacers 313. This coupling may be accomplished in a variety of ways, for example via a "snap-on" frame as discussed above with respect to FIGS. 7 and 11. Alternatively, the tracks 225 may be welded to laterally spaced sets of longitudinal spacers. As seen in FIG. 22, the tracks 225 slidingly receive and retain a plurality of drawers 226.

As can be seen from the above discussion of several illustrated embodiments, an end user may configure a modular space system into one of numerous possible variations, using a few flexible elements provided in accordance with the present invention. The space systems are simple to assemble and to reconfigure, thereby allowing the end user great flexibility. By providing enclosures of various configurations in accordance with the present invention, the versatility and functionality of the space system is increased, while providing an aesthetically pleasing appearance associated with traditional furniture.

An improved modular space system has been shown and described. From the foregoing, it will be appreciated that although embodiments of the invention have been described herein for purposes of illustration, various modifications may be made without deviating from the spirit of the invention. Thus, the present invention is not limited to the embodiments described herein, but rather is defined by the claims which follow.

What is claimed is:

1. A modular space system comprising:

a first lower frame having a plurality of first studs extending above an upper surface of the first lower frame;

a second frame having a plurality of second studs, each second stud having a first portion extending above an upper surface of the second frame and a second portion extending below a lower surface of the second frame; and a plurality of posts extending longitudinally between the first lower frame and the second frame and having a first open end and a second open end, the first open ends of the posts receiving the first studs and the second open ends of the posts receiving the second portion of the second studs, to couple the first lower frame and the second frame in longitudinally spaced relation to each other, the plurality of posts including a first forward post and a second forward post spaced laterally from each other and a first rearward post and a second rearward post spaced laterally from each other and from the first and second forward posts, the first forward post having a first slot aligned with a second slot provided in the first rearward post, a first planar member being received by and extending between the first and second slots, a third slot provided in the second forward post being aligned with a fourth slot provided in the second rearward post, a second planar member being received by and extending between the third and fourth slots, and a fifth slot provided in the first rearward post aligned with a sixth slot provided in the second rearward post, a third planar member being received by and extending between the fifth and sixth slots, the first, second and third planar members forming three sides of an enclosure, and wherein the first and second frames have a substantially tubular outer surface and a top surface and a bottom surface of each of the plurality of posts is provided with a groove having a curvature to matingly engage the tubular outer surface of the first and second frames.

2. The modular space system according to claim 1 wherein a plurality of gliders are coupled to an inner surface of each of the first and second planar members, a plurality of drawers being slidably engaged in the enclosure by the gliders.

3. The modular space system according to claim 1 wherein a door is pivotally coupled to opposing surfaces of the first and second forward posts to selectively allow access to the enclosure.

4. The modular space system according to claim 1 further comprising:

a plurality of first longitudinal spacers having a first open end and a second open end, the first open end of the first longitudinal spacers receiving the first portion of the second studs; and a third frame having a plurality of third studs, each third stud having a first portion extending above an upper surface of the third frame and a second portion extending below a lower surface of the third frame, the second open ends of the first longitudinal spacers receiving the second ends of the third studs to couple the third and second frames in longitudinally spaced relation to each other.

5. The modular space system according to claim 4 further comprising:

a fourth frame having a plurality of fourth studs extending below a lower surface of the fourth frame; and a plurality of second longitudinal spacers having a first open end and a second open end, the first open ends of the second longitudinal spacers receiving the first portions of the third studs and the second open ends of the second longitudinal spacers receiving the fourth studs, to couple the fourth and third frames in longitudinally spaced relation to each other.

6. The modular space system according to claim 5, wherein each of the first, second, third, and fourth frames have a generally rectangular configuration having first and second sets of parallel sides; and a board is placed on top of and supported by the upper surface of one of the sets of parallel sides of one or more of the first, second, third, and fourth frames.

7. The modular space system according to claim 6 further comprising:

a second board positioned on and supported by the other of the first and second sets of parallel sides of one or more of the first, second, third, and fourth frames.

8. A The modular space system according to claim 4, further comprising a plurality of tracks coupled to the first longitudinal spacers in parallel, spaced relation to each other, a plurality of drawers being slidingly received and retained by the tracks.

9. A modular space system comprising:

a first side having a first planar member coupled to and extending between a first post and a second post, a first bore extending longitudinally into a bottom surface of each of the first and second posts and a second bore extending longitudinally into a top surface of each of the first and second posts;

a second side having a second planar member coupled to and extending between a third post and a fourth post, a third bore extending longitudinally into a bottom surface of each of the third and fourth posts and a fourth bore extending longitudinally into a top surface of each of the third and fourth posts;

a third planar member being removably attachable to the first and second sides, the first side, second side, and third planar member forming three sides of a parallelogram-shaped enclosure when the third planar member is coupled to the first and second sides;

a support assembly extendible into the first and third bores to provide a bearing surface for the modular space system, the support assembly comprising a second frame having a plurality of second studs extending above an upper surface of the second frame to be received by the first and third bores; and a first frame having a plurality of first studs, each first stud having a first portion extending above an upper surface of the first frame and a second portion extending below a lower surface of the first frame, the second portions of the first studs being received by the second and fourth bores, and wherein the first and second frames have a substantially tubular outer surface and the top surface and the bottom surface of each of the first, second, third and fourth posts is provided with a groove having a curvature to matingly engage the tubular outer surface of the first and second frames.

10. The modular space system according to claim 9 wherein the second post has a first slot provided therein and the fourth post has a second slot provided therein aligned with the first slot, and the third planar member has a selected width and thickness to extend between and be received by the first and second slots.

11. The modular space system according to claim 9 wherein a plurality of gliders are coupled to an inner surface of each of the first and second planar members, a plurality of drawers being slidably engaged in the enclosure by the gliders.

12. The modular space system according to claim 9 wherein a door is pivotally coupled to opposing surfaces of the first and third posts to selectively allow access to the enclosure.

13. A modular space system comprising:

a first side having a first planar member coupled to and extending between a first post and a second post, a first bore extending longitudinally into a bottom surface of each of the first and second posts and a second bore extending longitudinally into a top surface of each of the first and second posts;

a second side having a second planar member coupled to and extending between a third post and a fourth post, a third bore extending longitudinally into a bottom surface of each of the third and fourth plosts and a fourth bore extending longitudinally into a top surface of each of the third and fourth posts;

a third planar member being removably attachable to the first and second sides, the first side, second side, and third planar member forming three sides of a parallelogram-shaped enclosure when the third planar member is coupled to the first and second sides;

a support assembly extendible into the first and third bores to provide a bearing surface for the modular space system;

a first frame having a plurality of first studs, each first stud having a first portion extending above an upper surface of the first frame and a second portion extending below a lower surface of the first frame, the second portions of the first studs being received by the second and fourth bores;

a plurality of first longitudinal spacers having a first open end and a second open end, the first open end of the first longitudinal spacers receiving the first portion of the first studs;

a second frame having a plurality of second studs, each second stud having a first portion extending above an upper surface of the second frame and a second portion extending below a lower surface of the second frame, the second open end of the first longitudinal spacers receiving the second end of the second studs to couple the first and second frames in longitudinally spaced relation to each other;

a third frame having a plurality of third studs extending below a lower surface of the third frame;

a plurality of second longitudinal spacers having a first open end and a second open end, the first open end of the second longitudinal spacers receiving the first portion of the second studs and the second open end of the second longitudinal spacers receiving the third studs, to couple the second and third frames in longitudinally spaced relation to each other, and wherein each of the first, second, and third frames have a generally rectangular configuration having first and second sets of parallel sides; and a board is placed on top of and is supported by the upper surface of one of the sets of parallel sides of at least one of the first, second, and third frames.

14. The modular space system according to claim 13, further comprising a plurality of tracks coupled to the first longitudinal spacers in parallel, spaced relation to each other, a plurality of drawers being slidingly received and retained by the tracks.

15. A modular space system comprising:

a first side having a first planar member coupled to and extending between a first post and a second post, a first bore extending longitudinally into a bottom surface of each of the first and second posts and a second bore extending longitudinally into a top surface of each of the first and second posts;

a second side having a second planar member coupled to and extending between a third post and a fourth post, a third bore extending longitudinally into a bottom surface of each of the third and fourth posts and a fourth bore extending longitudinally into a top surface of each of the third and fourth posts;

a third planar member being removably attachable to the first and second sides, the first side, second side, and third planar member forming three sides of a parallelogram-shaped enclosure when the third planar member is coupled to the first and second sides;

a support assembly extendible into the first and third bores to provide a bearing surface for the modular space system, the support assembly comprising a plurality of adjustable feet extending into the first and third bores; and a first frame having a plurality of first studs, each first stud having a first portion extending above an upper surface of the first frame and a second portion extending below a lower surface of the first frame, the second portions of the first studs being received by the second and fourth bores.

16. The modular space system according to claim 15 further comprising a fourth planar member selectively coupled to and extending between a lower region of each of the first, second, and third planar members to provide a substantially horizontal support surface.

* * * * *